US011559710B2

(12) United States Patent
Workman et al.

(10) Patent No.: US 11,559,710 B2
(45) Date of Patent: Jan. 24, 2023

(54) FIRE PROTECTION CONTAINMENT UNIT FOR INTERMEDIATE BULK CONTAINERS

(71) Applicants: Viking Group, Inc., Caledonia, MI (US); Minimax Viking Research & Development GmbH, Bad Oldesloe (DE)

(72) Inventors: Martin H. Workman, Delton, MI (US); Shawn J. Feenstra, Caledonia, MI (US); Derek J. Scheffers, Mattawan, MI (US)

(73) Assignees: Viking Group, Inc., Caledonia, MI (US); Minimax Viking Research & Development GmbH, Bad Oldesloe (DE)

( * ) Notice: Subject to any disclaimer, the term of this patent is extended or adjusted under 35 U.S.C. 154(b) by 0 days.

(21) Appl. No.: 17/641,033

(22) PCT Filed: Aug. 23, 2021

(86) PCT No.: PCT/US2021/047170
§ 371 (c)(1),
(2) Date: Mar. 7, 2022

(87) PCT Pub. No.: WO2022/046647
PCT Pub. Date: Mar. 3, 2022

(65) Prior Publication Data

US 2022/0347503 A1 Nov. 3, 2022

Related U.S. Application Data

(60) Provisional application No. 63/163,545, filed on Mar. 19, 2021, provisional application No. 63/070,794, filed on Aug. 26, 2020.

(51) Int. Cl.
*A62C 3/06* (2006.01)
*B65D 90/22* (2006.01)
*B65D 88/02* (2006.01)

(52) U.S. Cl.
CPC ..... *A62C 3/065* (2013.01); *B65D 88/02* (2013.01); *B65D 90/22* (2013.01)

(58) Field of Classification Search
CPC ..... A62C 3/065; B65D 88/02; B65D 90/22; B65D 77/0466; B65D 2519/008;
(Continued)

(56) References Cited

U.S. PATENT DOCUMENTS 5,052,569 A * 10/1991 Cooper ..... B65D 90/023 220/692
6,305,131 B1 10/2001 Romig
(Continued)

FOREIGN PATENT DOCUMENTS

AU 2018241046 1/2019
DE 202009010748 1/2010
(Continued)

OTHER PUBLICATIONS

International Searching Authority, International Search Report in International Appln. No. PCT/US2021/047170, dated Dec. 7, 2021, 15 pages.
(Continued)

*Primary Examiner* — Valentin Neacsu
*Assistant Examiner* — John Martin Hoppmann
(74) *Attorney, Agent, or Firm* — Perkins Coie LLP

(57) ABSTRACT

A fire protection containment unit for protection of an intermediate bulk container (IBC) having an internal flame and drain barrier disposed above a basin portion of the containment unit. The barrier includes pans having an impact surface that is angled to drain toward a central grid
(Continued)

of the barrier to direct escaped liquid from the IBC into the basin portion of the containment unit. The basin portion includes a base surface on an incline to define a pooling region of the containment unit to collect escaped liquid from the IBC. The containment unit includes containment walls which define various configurations of the containment unit including an open configuration, partially open configuration, a completely contained configuration and a packaged configuration.

17 Claims, 15 Drawing Sheets

(58) Field of Classification Search
CPC ..... B65D 2519/00502; B65D 19/06; B65D 19/40; B65D 2519/00333; B65D 90/24; B65D 2519/00024; B65D 2519/00273; B65D 2519/00298; B65D 2590/005; B65D 88/126; B65D 90/006; B65D 88/129; B65D 90/125; B65D 2519/00323; B65D 2519/00402; B65D 19/02; B65D 19/385; B65G 63/006; B65F 1/141; Y02W 30/10
USPC ..... 206/386, 600, 205; 220/560.03, 571, 220/565, 1.5, 23.87, 567.2, 636, 560.1, 220/571.1, 505, 4.12, 88.1
See application file for complete search history.

(56) References Cited

U.S. PATENT DOCUMENTS

| | | | | |
|---|---|---|---|---|
| 9,738,441 | B2 | 8/2017 | Le Blanc et al. | |
| 2015/0027917 | A1* | 1/2015 | Goddard | B65D 19/18 206/386 |
| 2015/0108139 | A1* | 4/2015 | Skeid | B65D 90/24 220/571 |

FOREIGN PATENT DOCUMENTS

| | | | | |
|---|---|---|---|---|
| EP | 2859919 | | 11/2013 | |
| EP | 2859919 | A2 * | 4/2015 | A62C 3/002 |
| WO | WO2018/073488 | | 4/2018 | |

OTHER PUBLICATIONS

Minimax Mobile Services, Technical Data, Fire Protection Trough for IBCs, BWCon 1.400, Sep. 2018, 2 pages.

* cited by examiner

FIRE PROTECTION CONTAINMENT UNIT FOR INTERMEDIATE BULK CONTAINERS

PRIORITY DATA AND INCORPORATION BY REFERENCE

This application is a 35 U.S.C. § 371 application of International Application No. PCT/US2021/047170, filed Aug. 23, 2021, which claims the benefit of U.S. Provisional Application No. 63/070,794, filed Aug. 26, 2020, and U.S. Provisional Application No. 63/163,545, filed Mar. 19, 2021, each of which is incorporated by reference in its entirety.

TECHNICAL FIELD

The present invention relates generally to fire protection containment units for intermediate bulk containers.

BACKGROUND ART

Intermediate Bulk Containers (IBCs) make up a category of large packaging that is characterized by the contents of the packaging and the size or capacity of the packaging. According to the International Organization for Standardization (ISO), IBCs are designed with a capacity ranging from 450 Liters [119 gal.] to three thousand Liters (3,000 L) [793 gal.] for containing liquids, pastes or solids that can include powders or granules. More generally, the size of the "intermediate" Bulk Container falls between two types of packaging: i) drum or sack packaging and ii) bulk portable tanks. Drums/sack packaging has an upper size/capacity limit of less than 450 Liters [119 gal.] and/or a weight of 400 kg. [882 lbs.] or less. Bulk portable tanks include road tank vehicles, rail tank cars/wagons or tank ships.

There are many industrial applications that use IBCs for transporting and storing combustible and flammable liquids. Typical field applications using such IBCs can be found in the chemical industry, mineral and petrochemical, rubber processing, textile industry, and food industry. The IBCs for transporting and storing combustible and flammable liquids can be constructed from metal, rigid plastics or composite materials.

There are known and commercially available fire protection containment units for IBCs used in the storage and transport of flammable liquids. An IBC containment unit is a storage cabinet or trough for storing the liquid filled IBC in the field of a manufacturing, process area, small storage or similar environment. Additionally, the containment unit provides a sump or basin for collecting the IBC liquid in the event of a damage or leak to the IBC. The containment unit captures the combustible or flammable liquid within the basin to limit the size of any potential fire or prevent its formation. Moreover, the sump area is sized to collect firefighting or extinguishing agent (water or foam solution) that may be dispensed into the containment unit to address any fire associated with the escaped liquid from the IBC.

An exemplary containment unit, with an IBC stored therein, is shown in European Patent No. EP 2,859,919. Known containment units structurally include a fluid-tight prismatic basin portion that is supported above the ground by an arrangement of support legs. The basin portion includes a planar base disposed parallel to the ground with four surrounding containment walls arranged to define the internal pooling region or volume of the basin portion for capturing and collecting liquid from the IBC. The IBC sits on an internal rack arrangement that is mounted over the basin portion. Separating the IBC from the basin portion is a flame and drain barrier constructed from a stainless-steel mesh filter mat that sits over the basin portion. Liquid leaking from the IBC hits the drain barrier and flows through to the basin portion for collection in the pooling region. In the event of a fire involving the IBC, the basin portion and barrier serve to separate any escaped liquid from the IBC and fire source. The containment unit also includes a containment portion defined by three or more containment walls mounted atop the basin portion that surround and protect the IBC. Some known containment units include a single horizontally pivoted door or splash guard to access the containment area for loading and unloading the IBC. The splash guard has a low height profile compared to the remaining walls of the containment portion.

In order to support the weight and volume of the IBC and its contents, known containment units are constructed from a combination of stainless steel and galvanized steel sheets and frames. Moreover to provide a sufficient internal volume for storage of the IBC and escaped liquid, the known rectangular prismatic containment units measure a little over two meters (2 m.) [7 ft.] high, about 1.5 meters [5 ft.] wide and about 1.8 m. meters (6 ft.) deep. The containment unit alone can weigh close to 450 kg. [1000 lbs.]. An exemplary commercially available containment unit from Minimax Mobile Services GmbH & Co. KG of Bad Urach, Germany is shown in their Product Brochure, PB01BWe: Fire Protection Trough for IBCs—BWCon 1.400 (July 2020). This steel containment unit can store an IBC containing up to 1,000 liters (265 gal.) of flammable liquid and weighing up to 1300 kg. (2900 lbs.). The basin portion of the containment unit includes a pooling region or sump area that is sized for collecting any escaped liquid from the IBC in addition to 400 liters (105 gal.) of extinguishing fluid. Accordingly, for this known IBC unit, the sump area defines an internal volume capacity of 1,400 liters (370 gal.). The escaped liquid and/or extinguishing agent can be removed from the basin area during maintenance operations. Although this known containment unit is effective in separating and shielding escaped liquid from the IBC, there remains a need for containment units that can improve drainage of the escaped liquid into the containment basin and collection of the liquid in the basin portion of the containment unit.

Given the weight, size and construction of the IBCs and the containment units themselves, the IBC and containment unit are handled and moved using forklifts and/or pallet trucks. For example, full IBCs are front loaded into the containment unit using a forklift; and in order to move a containment unit to a desired site, the unit must be empty and moved with a forklift or pallet truck. Accordingly, there is a continued need for IBC containment units that can be handled, moved and loaded while maintaining stability of the containment unit for safe use and dispensing of liquid from the IBC.

DISCLOSURE OF INVENTION

Preferred embodiments of a fire protection containment unit for protection of an intermediate bulk container (IBC) are provided. Accordingly, as used herein a "containment unit" is a structure having a size and construction sufficient for storage and containment of a full IBC and its contents. Preferred embodiments of the container unit provide for fire protection of an IBC and in particular a plastic IBC holding up to 1000 liters or more of flammable liquid. Preferred embodiments of the containment unit include a basin or sump portion with an internal flame and drain barrier disposed over the basin portion to collect escaped liquid from the IBC. The internal barrier has lateral pans disposed about a central grid member. The lateral pans are angled to drain escaped liquid from the IBC toward a central grid of the barrier to direct escaped liquid from the IBC into the basin portion of the containment unit. Preferred embodiments of the containment unit include a defined pooling region of the basin portion for collecting any escaped liquid. More particularly, the basin portion preferably includes a base at an angle of incline with respect to the ground to define the preferred pooling region and to facilitate and improve collection of escaped liquid into the pooling region. Additionally, preferred embodiments of the containment unit include a rack arrangement disposed over the preferred barrier to support and locate the IBC within a containment portion of the containment unit. The rack arrangement is preferably disposed at an inclined angle to facilitate dispensing of liquid from the IBC. Moreover, the containment unit preferably includes containment walls which define various configurations of the unit including an open configuration, partially open configuration, and a completely contained configuration which provide varying forms of access to the containment unit. The various configurations of the containment unit are defined by a preferred hinged door arrangement which provides access for loading and unloading of the containment unit, provides a splash guard to contain liquid within the containment unit and operates in a manner that maintains stability of the containment unit to prevent accidental tipping of the containment unit. A preferred delivery configuration of the unit is also provided by an arrangement of the containment walls which facilitates transport and delivery of the containment unit.

One preferred embodiment of a fire protection containment unit includes a basin portion having a planar base perpendicular to a central axis. The planar base preferably has a rectangular perimeter with a plurality of containment walls secured to the planar base surface to surround the central axis and define a fluid-tight rectangular prism chamber. The containment unit includes a pair of front legs and a pair of rear legs, each of the pairs of legs having a top surface secured to the planar base surface of the basin and a bottom surface that contacts the ground plane. A preferred flame and drain barrier of the containment unit is supported over the planar base and includes a plurality of strut members extending between two of the containment walls. The preferred flame and drain barrier also includes at least one pair of lateral pans and a central grid supported on the plurality of struts and suspended over the fluid-tight rectangular prism chamber. Each of the pair of lateral pans has a preferably rectangular drainage surface disposed with respect to the ground plane. Each drainage surface has four corners with each corner of the rectangular surface defining a distance from the ground plane in which the distances are preferably different from one another. Each containment wall in the plurality of containment walls of the containment unit forms a splash guard spaced about the central axis. In preferred embodiments of the containment unit, at least one splash guard preferably defines a door having a first door panel in a first horizontal hinged relationship with a wall in the plurality of containment walls and a second door panel in a second horizontal hinged relationship with the first panel.

Another preferred embodiment of a fire protection containment unit for an intermediate bulk container (IBC) includes a basin portion having a base disposed perpendicular to a central axis and a first plurality of containment walls disposed about the base and which surround the central axis. A containment portion includes a second plurality of containment walls that surround the central axis for the protection of the IBC. The second plurality of containment walls includes at least three walls axially atop the basin portion and another wall preferably defining a door of the containment portion of the unit. The preferred door has a first door panel in a first horizontal hinged relationship with the basin portion and a second door panel in a second horizontal hinged relationship with the first panel. Preferred embodiments of the containment unit include a preferred frame arrangement that defines a preferred nested relationship between the first and second door panels.

Preferred embodiments of the containment unit include a containment portion for housing the IBC, a basin portion having a base at an angle of incline to define a preferred pooling region; and an internal flame and drain barrier supported between the containment portion and the basin portion to catch escaped liquid from the IBC and direct the escaped liquid into the basin portion. The barrier preferably includes a plurality of lateral pans with a central grid member in between. Additionally, the preferred containment unit includes a plurality of splash guards spaced about the containment and the basin portion. At least one splash guard includes a first panel in a first horizontal hinged relationship with the basin portion and a second panel in a second horizontal hinged relationship with the first panel.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1:
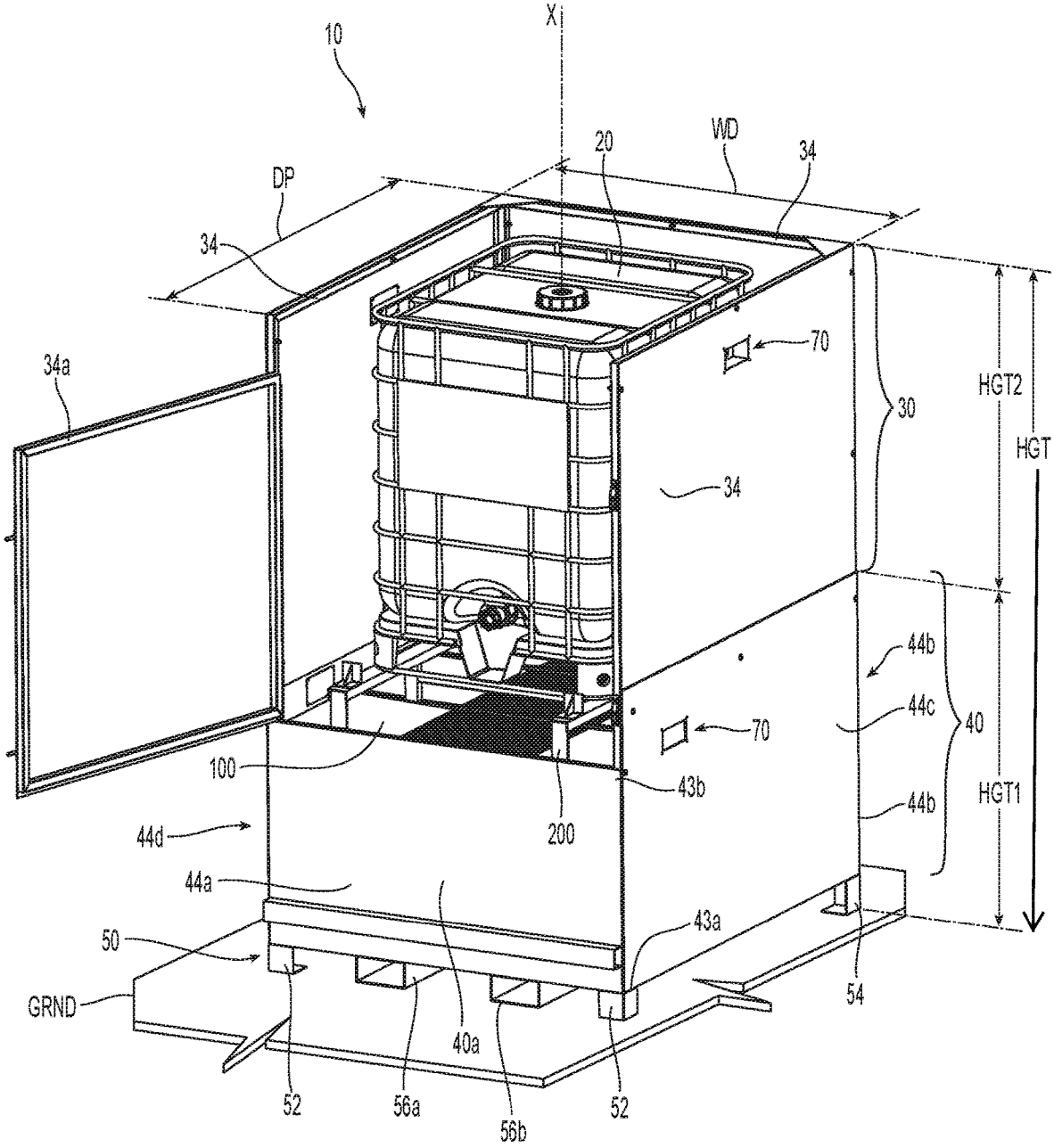
FIG. 1 is a perspective view of a preferred embodiment of a fire protection containment unit for an intermediate bulk container (IBC).

FIG. 1 illustrates a perspective view of a fire protection containment unit 10 that provides a housing enclosure for an intermediate bulk container (IBC) 20, preferably composite IBC 20, that contains a liquid, such as for example, a flammable liquid. The fire protection containment unit 10 includes a containment portion 30 to locate, house and support the IBC 20 to protect it from physical damage from accidental impact during storage, transport or during use. Moreover, the containment unit 10 includes a fluid tight sump or basin portion 40 below the containment portion 30 to capture and contain any spilled or escaped liquid from the IBC 20 in the event of a container rupture or fracture and additionally hold firefighting or extinguishing agent dispensed into the unit in the event of a fire. The containment unit 10 includes a preferred support portion 50 beneath the basin portion 40 which supports the containment and basin portions 30, 40 above the ground GRND to provide the appropriate spacing to accommodate forks of a forklift or pallet truck for moving the containment unit 10 alone or with any IBC 20 contained therein. Moreover, in preferred embodiments of the containment unit 10 described herein, the preferred support portion 50 inclines the rest of the containment unit 10 to facilitate drainage and collection of any escaped liquid from the IBC 20.

In general, preferred embodiments of the containment unit 10 include structural arrangements that direct any escaped liquid into a preferred pool region of the basin portion 40 for collection. The collected liquid can then be removed by vacuum using one or more access ports of the containment unit. In one preferred embodiment of the containment unit 10, an internal barrier 100 is provided that is disposed beneath the IBC 20 to catch and redirect any escaped liquid therefrom. The preferred internal barrier 100 includes one or more preferred impact surfaces that are angled to direct any escaped liquid that falls thereon to drain into the basin portion 40. Alternatively or additionally, the basin portion 40 and support portion 50 are structurally arranged to facilitate pooling of any escaped liquid into the preferred pool region of the basin portion 40. Preferably disposed within the containment unit 10 and supported on the barrier 100 is a rack arrangement 200 to support the IBC 20 within the containment portion 30. In preferred embodiments of the containment unit 10, the rack arrangement 200 is configured to tilt the IBC 20 to facilitate dispensing of the liquid from the IBC 20. Moreover, the barrier 100 acts as a preferred flame barrier between any escaped liquid in the basin 40 and the IBC 20 in the event of a fire.

Figure 1A:
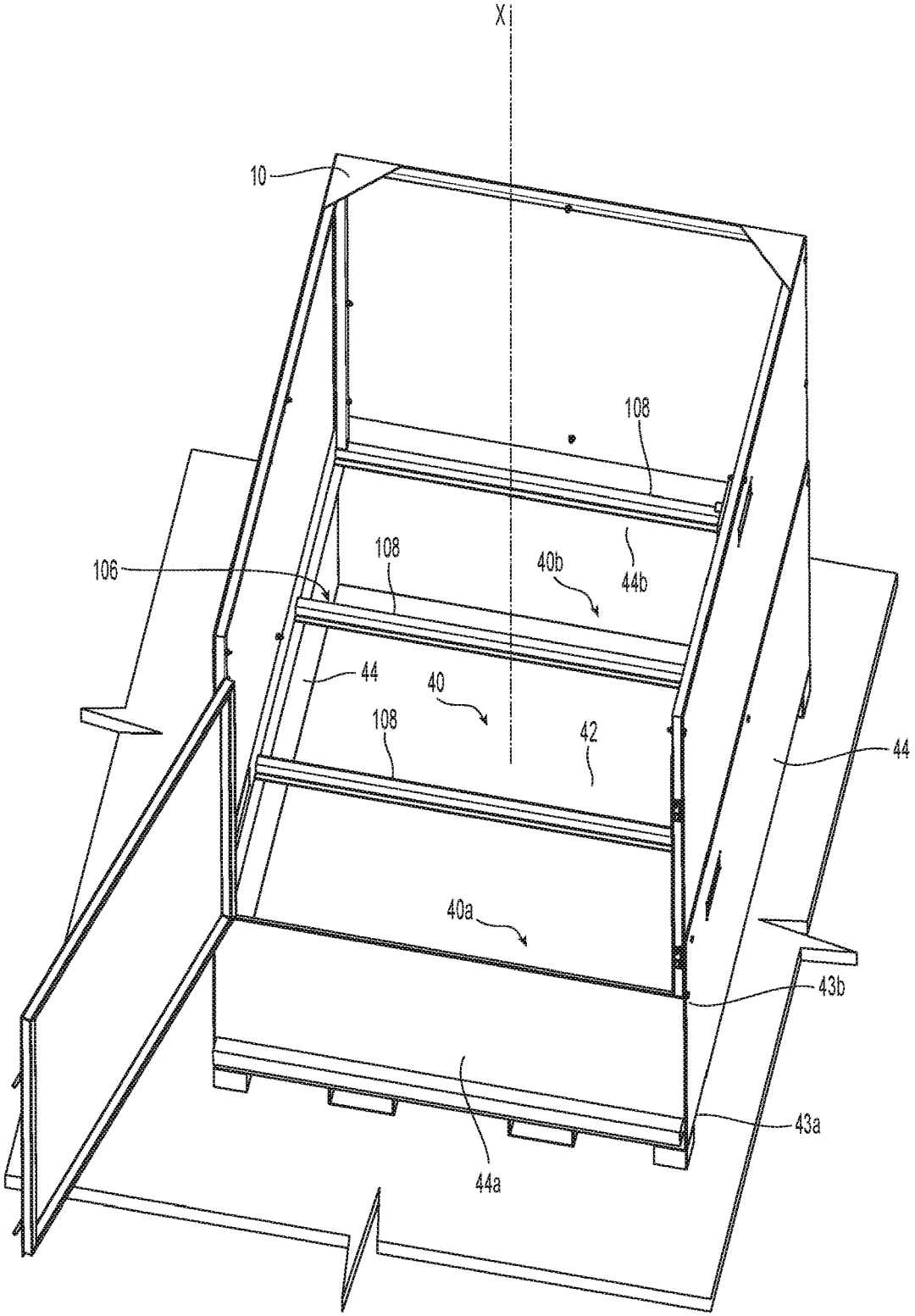
FIG. 1A is another perspective view of the containment unit of FIG. 1.

Shown in FIG. 1A is another perspective view of the containment unit 10 with the IBC 20, rack arrangement 200 and most of the barrier 100 removed to show the basin portion 40. The containment unit 10 defines a preferably rectangular prism centered about a central axis X-X for housing the IBC 20. The preferred basin portion 40 is defined by a preferred rectangular base 42 disposed perpendicular to the central axis X-X. Four planar containment walls 44 disposed about the perimeter of the base 42 surround the central axis X-X to form the fluid tight preferably rectangular prismatic chamber of the basin 40 having a front region 40*a* and rear region 40*b*. Generally, the containment unit 10 is constructed and sized to house an IBC 20 containing up to 1000 liters (265 gal.) of liquid volume weighting up to 1300 kg. (2900 lbs.), preferably up to 1040 liters (275 gal.) of liquid weighting up to 1352 kg. (2981 lbs.) and more preferably at least 1250 liters (330 gal.) of liquid and weighting up to 1600 kg. (3500 lbs.). The basin portion 40 has a preferred holding capacity that is preferably at least 110% of the maximum volume of the IBC 20 and more preferably 150% of maximum volume of the IBC 20. The basin portion 40 defines a preferred holding capacity of at least 1,105 liters (292 gal.), more preferably up to 1,400 liters (370 gal.), even more preferably up to 1,562 liters (413 gal.) yet even more preferably up to 1,625 liters (430 gal.), even more preferably 1,750 liters (462 gal.) and yet even more preferably 1,875 liters (495-500 gal.). Accordingly, the basin portion 40 is preferably configured with a capacity to hold the entire volume of the IBC 20 and an additional fifty percent (50%) for a firefighting liquid or material such as, for example, a suppression agent or foam. Generally, in the event a fire within the unit 10, the IBC 20 can be permitted to melt. The preferred additional 50% of holding volume for suppression agent preferably provides for a twenty minute (20 min.) discharge time from a fire protection system, such as from a fire protection sprinkler, nozzle or other discharge device, into the containment unit 10. In a preferred aspect, the preferred discharge time is equivalent to the fire rating time of the IBC 20.

Each of the containment portion 30 and basin portion 40 include containment walls of a height and length to form an effective splash guard around the IBC 20. Moreover, the basin portion 40 defines a preferred footprint in which liquid can be captured to limit the size of a potential pool fire. In preferred embodiments of the prismatic containment unit described herein, the containment portion 30 and basin portion 40 are each dimensionally about 1.5 meters wide WD (5 ft.) and about two meters (6½ ft) deep DP (front to rear). More preferably, embodiments of the containment unit 10 can have a width WD ranging from 1.4 meters wide (4.5 ft.) to 1.47 meters wide (4.8 ft.) with a depth of about 1.7-1.8 meters (5.8-5.9 ft.) deep DP. Together, the containment portion 30 and basin portion 40 define a preferred height HGT of the containment unit 10, as seen in FIG. 1, being at least about two meters (6½ ft.) high and more preferably over two meters. In some preferred embodiments, the containment unit 10 is about seven feet (7 ft.) high and more preferably, the containment unit 10 is over seven feet (7 ft.) high and even more preferably between 7½ ft. to eight (8 ft.) such, as for example, 7⅔ ft. (2¼ m) high. In one preferred embodiment of the containment unit 10, the unit is at least 2.1 meters (7 ft.) high, about 1.5 meters wide WD (5 ft.) and about two meters (6½ ft.) deep DP. In a preferred aspect of the unit 10, the exposed surface area is preferably limited to an area no larger than 1.5 $m^2$ (17 $ft.^2$). The basin portion 40 defines a maximum height HGT1 and the containment portion 30 defines a maximum height HGT2. In preferred embodiments of the unit 10, the heights HGT1, HGT2 of the basin and containment portions 40, 30 are preferably equal to one another; and each height HGT1, HGT2 is preferably 40-50% the total height HGT of the containment unit. Alternatively, the containment unit 10 and its containment and basin portions can define alternate geometries provided the containment portion can house the IBC 20 and the basin portion 40 is a fluid tight chamber that is capable of securely capturing and containing any potential IBC spillage along with extinguishing agent that may be dispensed into the unit.

For example, the containment unit 10, the basin portion 40 and its base 42 of the basin portion 40 could be a squared prism or circular cylindrical.

With reference to FIG. 1, each of the containment walls 44 extends preferably perpendicular from the base 42 with a lower boundary 43*a* of the containment wall 44 forming a fluid tight joint with the base 42 and an upper boundary 43*b* of the containment wall 44 defining an upper boundary of the basin portion 40. The flame and drain barrier 100 is preferably supported proximate the upper boundary 43*b* of each of the lateral containment walls 44. In the preferred rectangular prism containment unit 10, there is a front containment wall 44*a*, a rear containment wall 44*b* and two lateral containment walls 44*c*, 44*d* that extend between the front and rear containment walls 44*a*, 44*b*. The shortest linear distance between the lower boundary 43*a* and the upper boundary 43*b* defines the height of the containment wall 44. Preferred embodiments of the front containment wall 44*a* of the containment unit 10 define a height that is smaller than the heights of the remaining containment walls 44*b*, 44*c*, 44*d*.

Preferred embodiments of the basin portion 40 are fluid tight at the joints between planar base 42 and the containment walls 44 and between the containment walls themselves. The base 42 and one or more walls 44 can be integrally formed or may alternatively be joined together, for example, by a weld. Similarly, the containment walls 44 can be integrally formed or joined to one another by a weld or other joint formation provided the connections are fluid tight. Accordingly, embodiments of the basin portion 40, its base 42 and walls 44 are preferably constructed or formed from a weldable steel such as, for example, carbon steel. Moreover, other preferred components or sections of the containment unit 10 described herein can also be constructed from panels and/or structural members made of steel, such as for example, carbon steel, stainless steel, or galvanized steel or other appropriate material suitable for joining to one another by welding, appropriate fastening assemblies or other mechanical connections in order to provide the support and protection of the IBC 20 and fire protection as described herein. The structural members descried herein can be fabricated using tubing, channel or angled members fabricated in a manner to support and/or join sections or components of the containment unit 10 in a manner as described herein.

Figure 2:
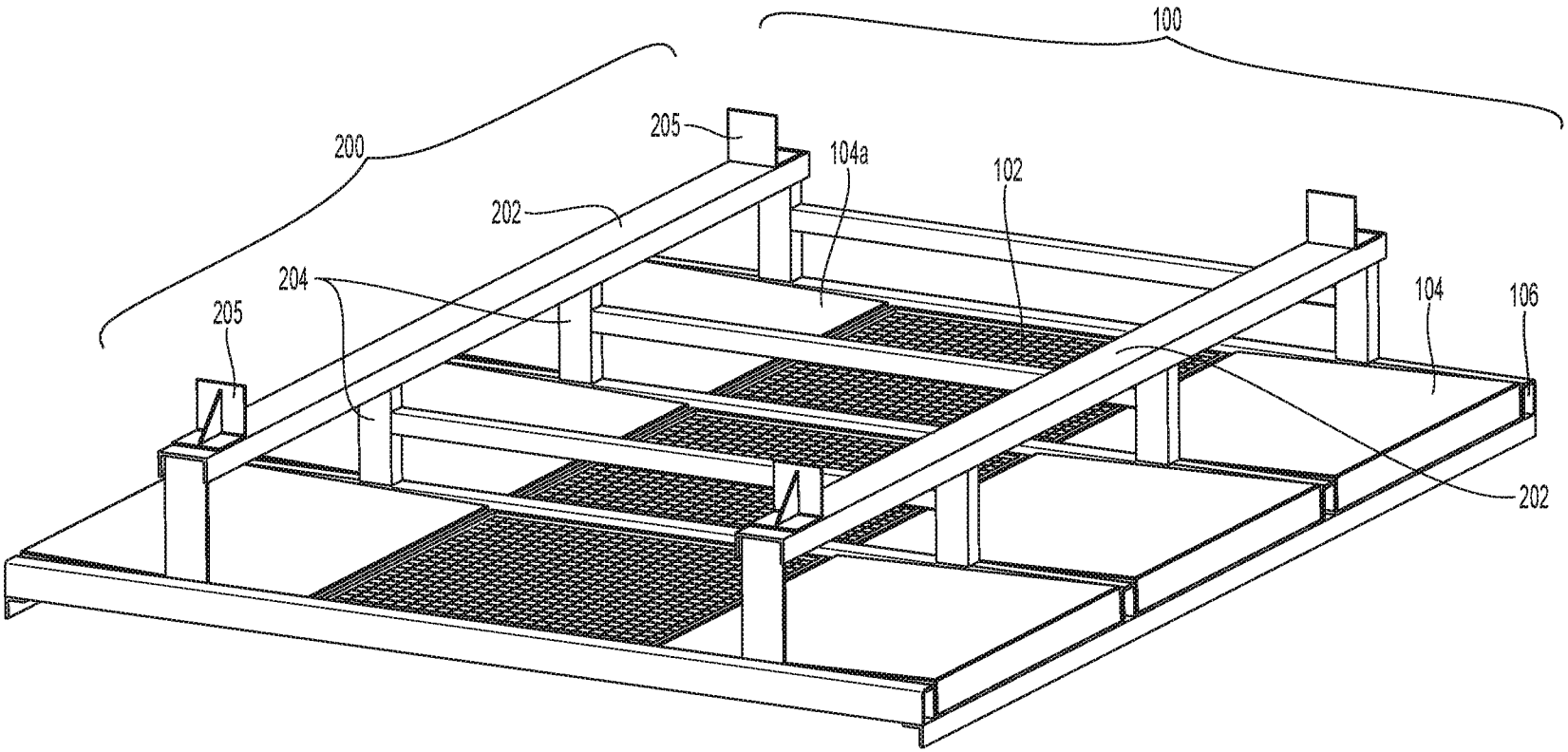
FIG. 2 is a perspective view of a preferred flame and drain barrier and rack system for use in the containment unit of FIG. 1.
Figure 2A:
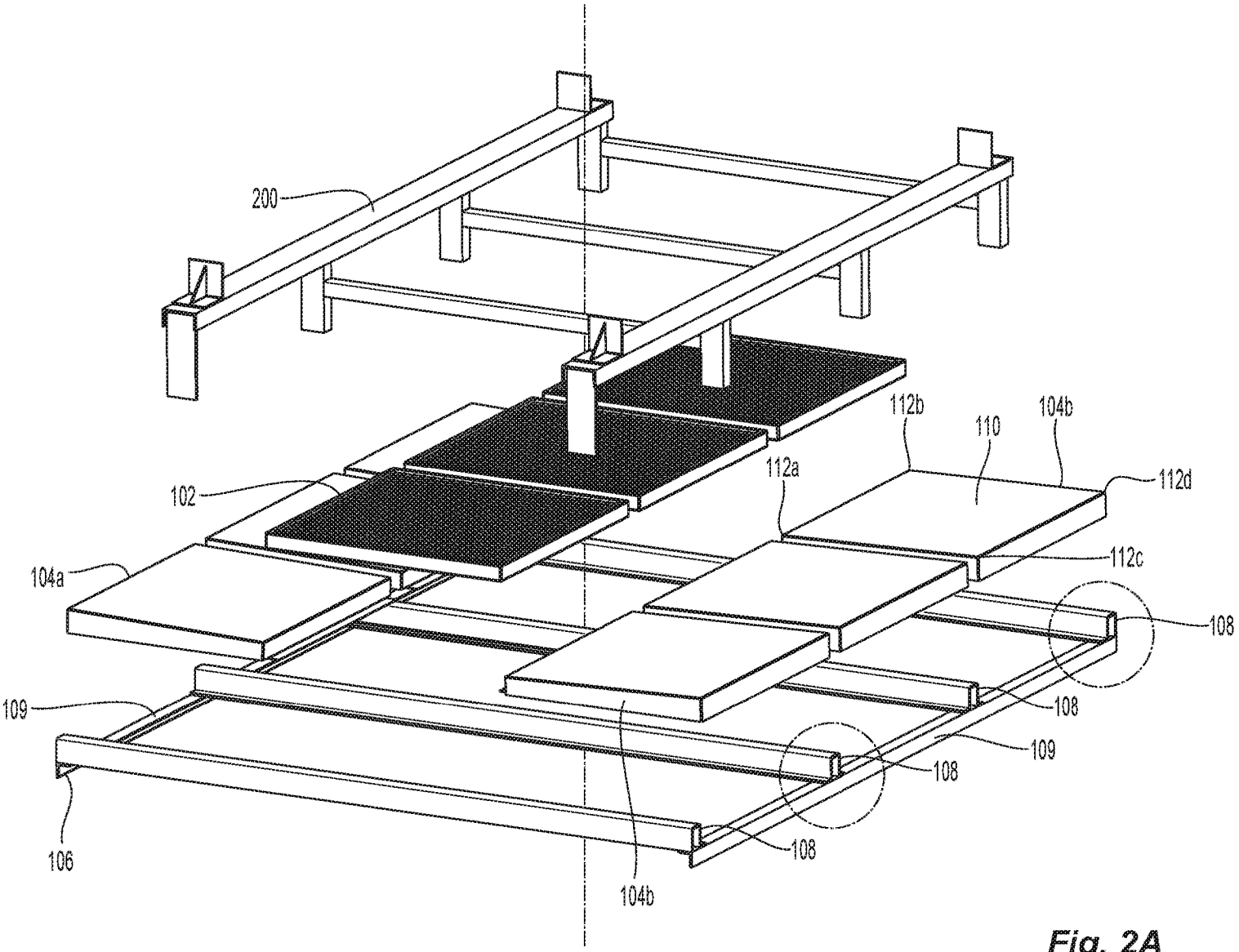
FIG. 2A is a perspective exploded view of the flame and drain barrier and rack system of FIG. 2.
Figure 2B:
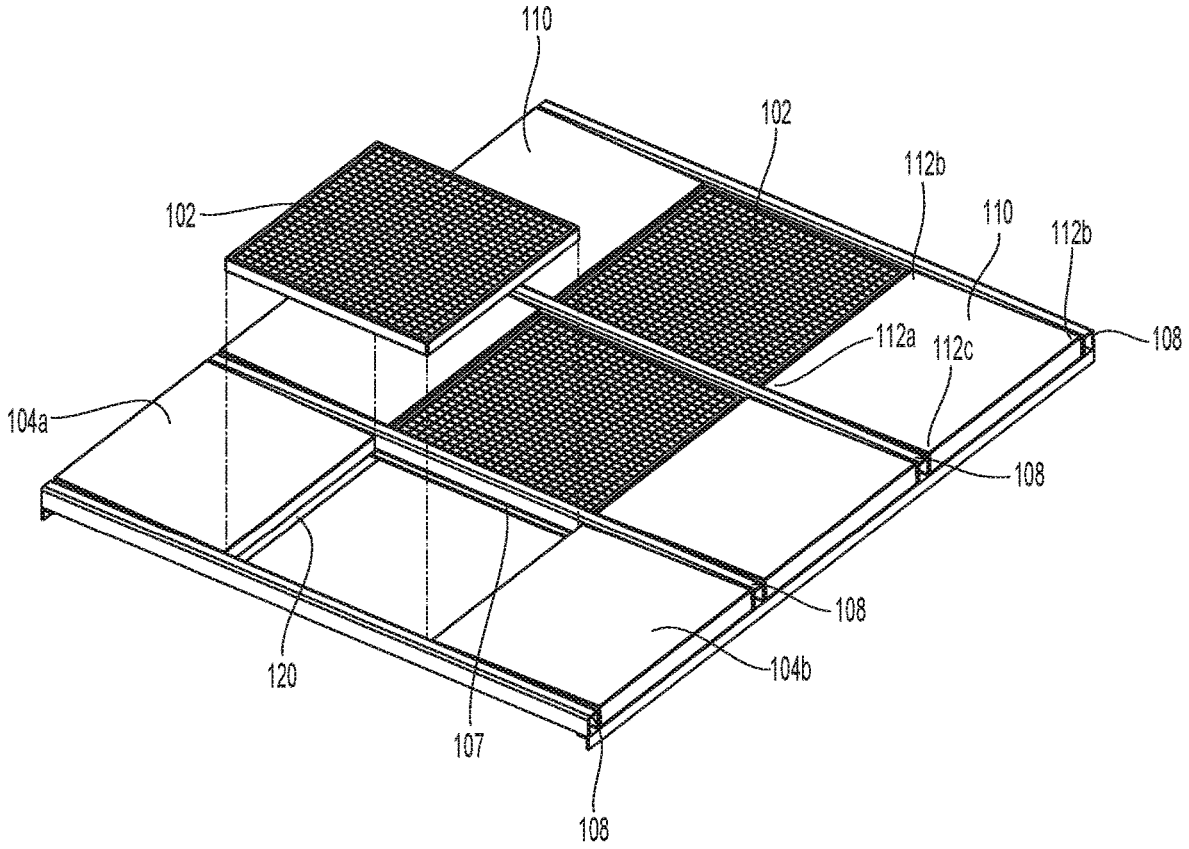
FIG. 2B is another perspective exploded view of the flame and drain barrier of FIG. 2.

Shown in FIGS. 2 and 2A are perspective views of the preferred flame and drain barrier 100 and rack 200; and FIG. 2B shows a perspective partially exploded view of the barrier 100. Preferred embodiments of the barrier 100 include a central grid 102 and lateral pans 104*a*. 104*b* disposed about the central grid 102. In preferred embodiments of the barrier 100, the central grid 102 includes a plurality of grid members 102 and each of the lateral pans 104*a*, 104*b* include a plurality of pan members. Each lateral pan 104 includes a preferably solid rectangular upper drainage impact surface 110 defining two preferred medial corners 112*a*, 112*b* proximate the central grid member 102 and two lateral corners 112*c*, 112*d* at the lateral edge of the barrier 100. The impact surfaces 110 are preferably angled for drainage toward the central grid member 102. The central grid member 102 is preferably porous and more preferably formed from a gridded material such as, for example, a mesh wire. Any leaked fluid falling on the grid 102 from the IBC 20 directly, or indirectly from the pan members 104, would fall through the grid member 102 and into the basin portion 40 below for capture. In preferred embodiments, the grid member 102 is preferably about two feet-by-two feet and more preferably about twenty-one inches-by-twenty-one inches (21 in.×21 in.).

Figure 3:
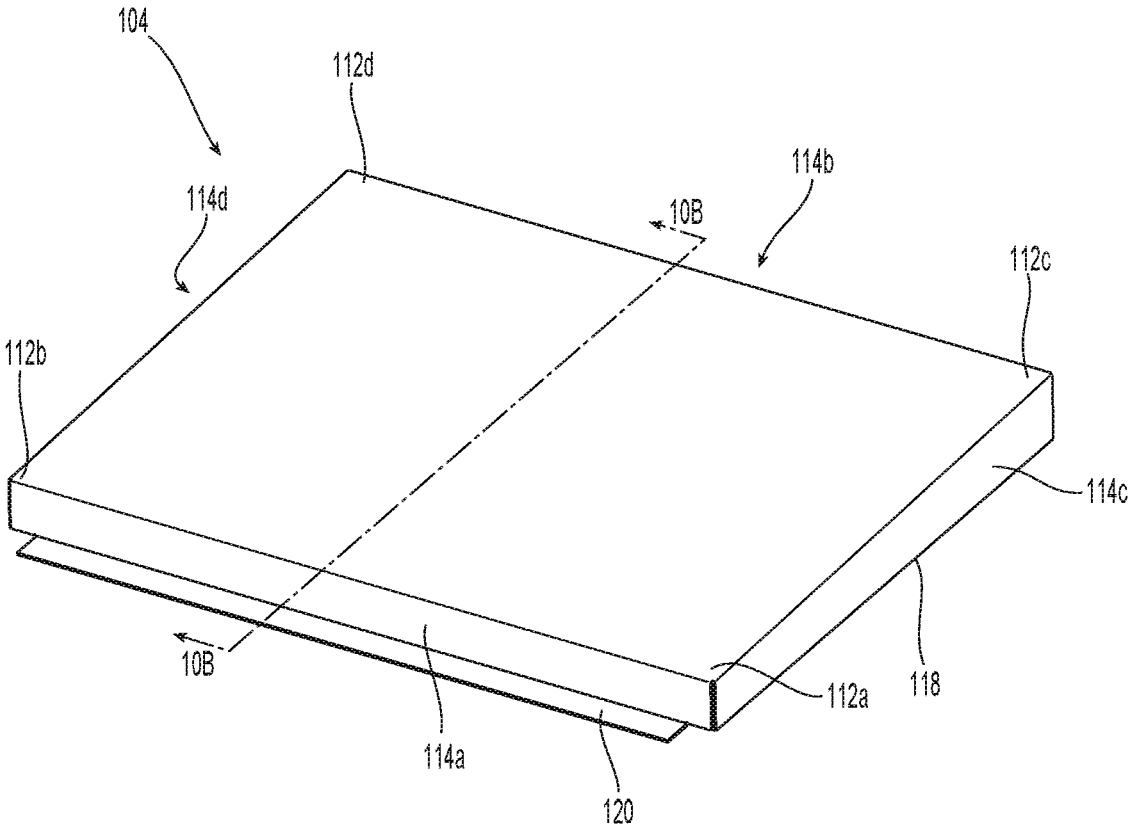
FIGS. 3 and 3A-3B are various views of a preferred lateral pan for use in the flame and drain barrier and rack system of FIG. 2.
Figure 3A:
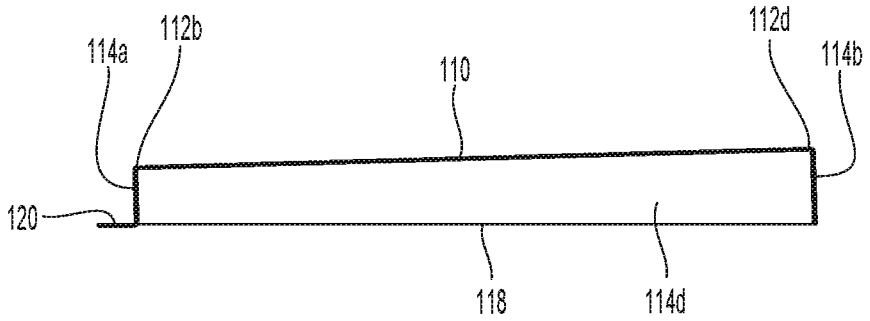

Shown in FIGS. 3 and 3A are various detailed and schematic views of a preferred drain pan 104 for use in the barrier 100. Extending between each corner 112 is one of four sidewalls 114 including a medial sidewall 114*a* a lateral sidewall 114*b* with a pair of connecting sidewalls 114*c*, 114*d* extending from the lateral sidewall 114*b* to the medial sidewall 114*a*. Each sidewall 114 has a bottom edge 118 that defines the length of the sidewall 114. With the bottom edges 118 of each sidewall 114 laying in a common plane, as seen in FIG. 3A, the height of each connecting sidewall 114*c*, 114*d* varies along its length preferably to define a common constant slope with a minimum height preferably at the medial end of the connecting sidewall 114*c*, 114*d* and a maximum height at the lateral end of the connecting sidewalls 114*c*, 114*d*. In the common plane, the medial and lateral sidewalls 114*a*, 114*b* define a preferred length of about twenty-one inches (21 in.) and the lateral sidewalls 114, 114*b* define a preferred length of about eighteen inches (18 in.). Moreover, the heights of the medial sidewall 114*a* and the lateral sidewall 114*b* are preferably consistent along their respective lengths with the height of the lateral sidewall 114*b* being greater than the height of the medial sidewall 114*a*. Again with reference to FIG. 3A, in the preferred embodiment of the pan 104 with the bottom edges 118 of each sidewall 114 laying in a common plane, the medial corners 112*a*, 112*b* are preferably located at a common first height from the common plane and the lateral corners 112*c*, 112*d* are preferably located at a common second height that is a greater than the first common height such that any liquid impacting the surface 110 drains in a direction from the lateral end to the medial end.

Figure 3B:
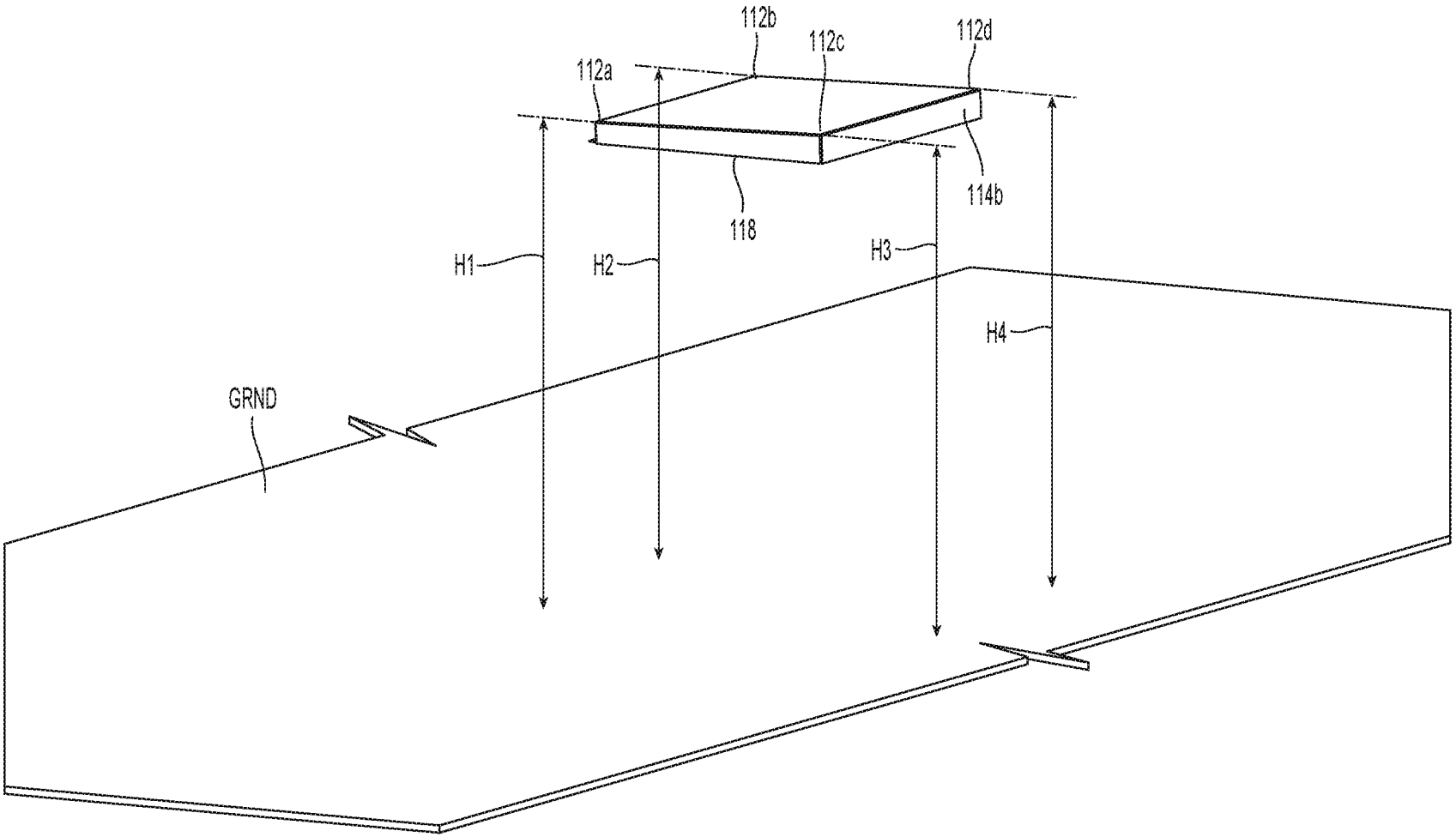
Figure 4:
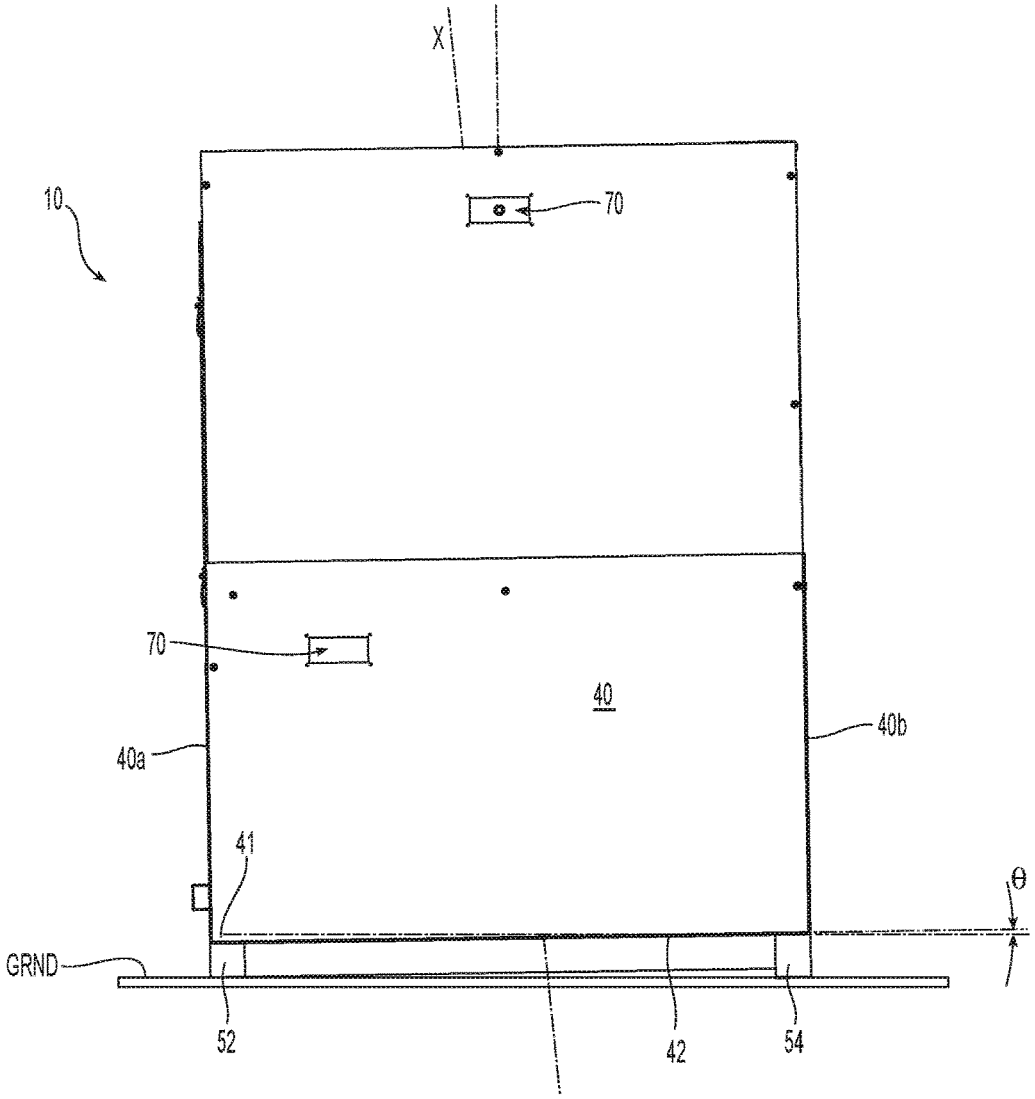
FIG. 4 is a side view of the containment unit of FIG. 1.

With reference to FIGS. 1 and 4, the support portion 50 in preferred embodiments of the containment unit 10, is structurally arranged to incline the containment unit 10 and the internal barrier 100. The front and rear legs 52, 54 are of different heights in order to provide a preferred forward incline of the containment unit 10. The incline results in the various pan corners 112*a*, 112*b*, 112*c*, 112*d* being preferably located at different heights above the ground plane GRND as schematically shown in FIG. 3B. The support portion 50 includes a first pair of front legs 52 and a second pair of rear legs 54. The preferred angle of incline of the pans 104 facilitate flow of escaped liquid toward the central grid 102 and the front region 40*a* of the basin portion 40. Accordingly, for each pan 104 in preferred embodiments of the containment unit 10, the first height H1 of the front medial corner 112*a* is the minimum height of the pan 104 and the fourth height H4 of the rear lateral corner 112*d* is the maximum height of the pan 104, with the second height H2 of the rear medial corner 112*b* greater than the first height H1 and third height H3 of the rear medial corner 112*b* greater than the second height H2. In the installed fire and drain barrier 100, the variable heights of the corners 112*a*, 112*b*, 112*c*, 112*d* of the drain pans 104 direct any liquid dripped thereon from a damaged IBC 20 toward the central grid 102 and in a direction toward the front region 40*a* of basin portion 40 of the containment unit 10. In alternate embodiments of the containment unit 10, the internal barrier 100 can be mounted on an incline within the containment unit 10 to place the pans 104 on the preferred incline to provide the differential heights of the pan corners 112*a*, 112*b*, 112*c*, 112*d*.

As seen in FIGS. 2 and 2A, the preferred barrier 100 includes a strut arrangement 106 upon which the preferred plurality of grid and pan members 102, 104 are arranged and supported. The strut arrangement 106 preferably includes a group of spaced apart strut members 108 that, as shown in FIG. 1A, extend across the containment walls 44*c*, 44*d* to suspend the grid member 102 and pan member 104 over the preferably rectangular prismatic chamber of the basin portion 40. The strut members 108 are preferably affixed to a pair of angle members 109 of the strut arrangement that can be mounted to the internal surface of the containment walls 44 of the basin portion 40. Referring again to FIGS. 2 and 2A-2B, the strut members 108 are spaced apart from one another to support one pair of lateral pans 104*a*, 104*b* with a grid member 102 centered therebetween. Each of the strut members 108 preferably include a shelf 107 upon which the bottom edge 118 of the lateral pans 104 can rest and be supported. Preferably formed or extending from the bottom edge 118 of the medial sidewall 114*a* of the pans 104 is a supporting lip 120 for supporting the grid member 102 preferably below the impact surfaces 110 of the pans 104.

Preferred embodiments of the containment unit 10 include a pool region 41 in the basin portion 40. Shown schematically in FIG. 4 is the preferred pool region 41 defined by a volume of the basin 40 proximate the front region 40*a* of the base 40 in which escaped liquid from an IBC can collect. To define the preferred pool region 41, the base 42 is preferably inclined forward at an angle θ with respect to a plane parallel to the ground GRND. Accordingly, the angle θ of incline is greater than zero and preferably less than forty degrees (40°), more preferably less than ten degrees (10°) and yet even more preferably less than one degree (1°). The preferred incline of the base 42 causes escaped liquid captured in the basin portion 40 to collect in the pool region 41 under the force of gravity. The preferred support portion 50 structurally inclines the base 42 along with the remainder of the containment unit 10. Preferred legs 52, 54 are formed to have a top surface 53 secured to the base 42 and a bottom surface 55 to contact and rest upon the ground GRND. The front legs 52 are preferably of a smaller height HH1 than the height HH2 of the rear legs 54 to incline the base 42 forward and define the preferred pooling region 41. In preferred embodiments of the support portion 50, the height HH1 of the front legs 52 and the height of the rear legs 54 define a preferred height differential that preferably ranges from 1/32 inch to 1/4 inch and more preferably ranges from 3/32 to 5/32 inches.

Moreover, by preferably inclining the containment unit 10, the strut arrangement 106 can be equally inclined to incline the barrier 100 and facilitate drainage to the pooling region. Additionally, in the internal rack system 200, the IBC 20 is also placed on an incline which can facilitate dispensing of liquid from the container. Alternatively, the barriers 100 and internal rack arrangements 200 can be separately inclined within the containment unit to facilitate dispensing and the drainage and capture of any escaped liquid. Accordingly, in alternate embodiments, the base 42 can be configured, alone or in combination with the legs 52, 54, to incline the base in a rearward direction to define and locate the preferred pooling region 41 proximate the rear region 40*b* of the containment unit 10. Additionally, the base 42 can be inclined laterally to one side or another of the containment unit 10. In another alternate embodiment of the containment unit 10, the base 42 can be inclined toward one leg in the pair of legs 52, 54 so that the base 10 is angled toward one corner of the preferably rectangular base 42.

A preferred embodiment of the rack arrangement 200 is shown in FIG. 2. The rack 200 includes a pair of parallel siderails 202 that are spaced apart from one another and extend from the rear region 40*b* to the front region 40*a* to support the IBC 20 over the barrier 100 and the basin 40. To space the IBC 20 above the grid member and the lateral pans 104, the rack system includes a plurality of vertical members 204 upon which the siderails 202 are mounted. The vertical members 204 rest upon and preferably affixed to the laterally extending strut members 108 of the strut arrangement 106. The vertical members 204 can be of equal height or alternatively be of variable height to independently incline siderails 202 either rearward or forward. The preferred rack arrangement 200 includes stop members 205 mounted atop the siderails to locate and preferably center the IBC on the rack 200. The rack arrangement 200 can include one or more rail members 203 between and parallel to the siderails 202 to support the IBC 20. In a preferred aspect, the side rails 202 and rail members 203 can be spaced apart at a preferred spacing that ranges between one to two feet (1-2 ft.) and is more preferably spaced apart at a distance of 1½ ft. (18 in.). Moreover, additional vertical members (not shown) can extend between the base 42 and the laterally extending strut member 108 to support the IBC 20, rack arrangement 200 and barrier 100 against the base 42 and the support portion 50. In addition to the stop members 205, each of the siderails 202 and supporting rail members 203 can include roller members or tracks atop the members 202, 203 to facilitate rolling support for the IBC 20 in a back-to-front direction as seen, for example, in FIG. 5D.

Figure 4A:
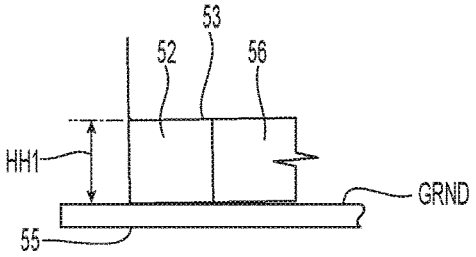
FIGS. 4A-4B are partial detailed views of a preferred support for use in the containment unit of FIG. 1.
Figure 4B:
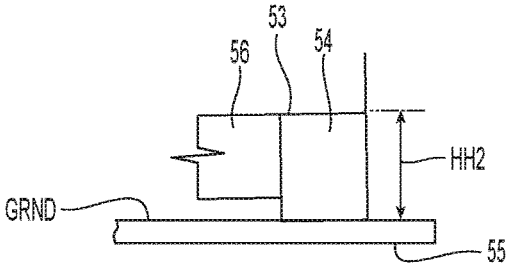

The support portion 50 also facilitates the portability of the containment unit 10. Referring again to FIGS. 1 and 4A-4B, the support portion 50 preferably includes two spaced apart channel members 56*a*, 56*b* that are sized and spaced to receive fork members of a fork truck or other material handling equipment. The channel members 56*a*, 56*b* are preferably mounted to the bottom of the base 42 between the legs 52, 54 of the support portion 50. The channel members 56*a*, 56*b* preferably extend from the front 40*a* to the rear 40*b* of the base portion at the preferred incline angle θ.

With reference to FIG. 1, the containment portion 30 of the preferably prismatic containment unit includes four adjacent containment walls 34 that are interconnected to one another to surround the central axis X-X for the housing and protection of the IBC 20 contained therein from accidental impact. In the preferred embodiment shown with the containment portion 30 preferably formed or disposed atop the basin portion, the walls 34 are preferably affixed atop the containment walls 44 of the basin portion 40. In addition to providing protection against accidental impact to the IBC 20, each of the walls 34 serve as a splash guard to maintain any escaped liquid within the unit 10. One or more of the containment walls 34, 44 of the containment unit 10 are configured to provide access to the internal volume of the containment unit for either loading and removing the IBC 20 or for removing any leaked liquid collected in the basin portion 40. As seen in FIG. 1, the containment walls 34 include a wall preferably at the front of the containment unit 10 that is preferably configured as a vertically hinged door 34*a* for loading on and unloading off the IBC 20 from the rack 200. Accordingly, the door 34*a* is preferably located above the front wall 44*a*; and with the door 34*a* open, the basin portion 40 becomes accessible. The vertically swinging door is preferably about five feet wide and three and one-half feet high, more preferably (4¾ ft.×3½ ft.). Given the preferred steel construction of the unit 10 using galvanized steel, the single vertical hinge is sufficiently robust for repeated operation of the door. Alternatively or additionally, one or more of the containment walls 34 preferably includes an access port 70 through which fire protection and/or material handling equipment and devices can extend. For example, a vacuum device can be inserted into an access port 70 located along the basin portion to remove any liquid located in the preferred pool region 41 of the basin 40. Additionally, the access ports 70 can be positioned and used to provide hose connections to the fill or dispensing ports of the IBC to respectively and directly fill or dispense fluid from the IBC 20. The containment unit 10 has a preferred open top. Accordingly, the containment unit 10 can be positioned beneath a fire protection system, firefighting extinguishing device or fire control device such as, for example, a sprinkler, nozzle or mist device that can dispense a firefighting fluid, material or agent to address any fire or potential fire around the IBC 20.

Figure 5:
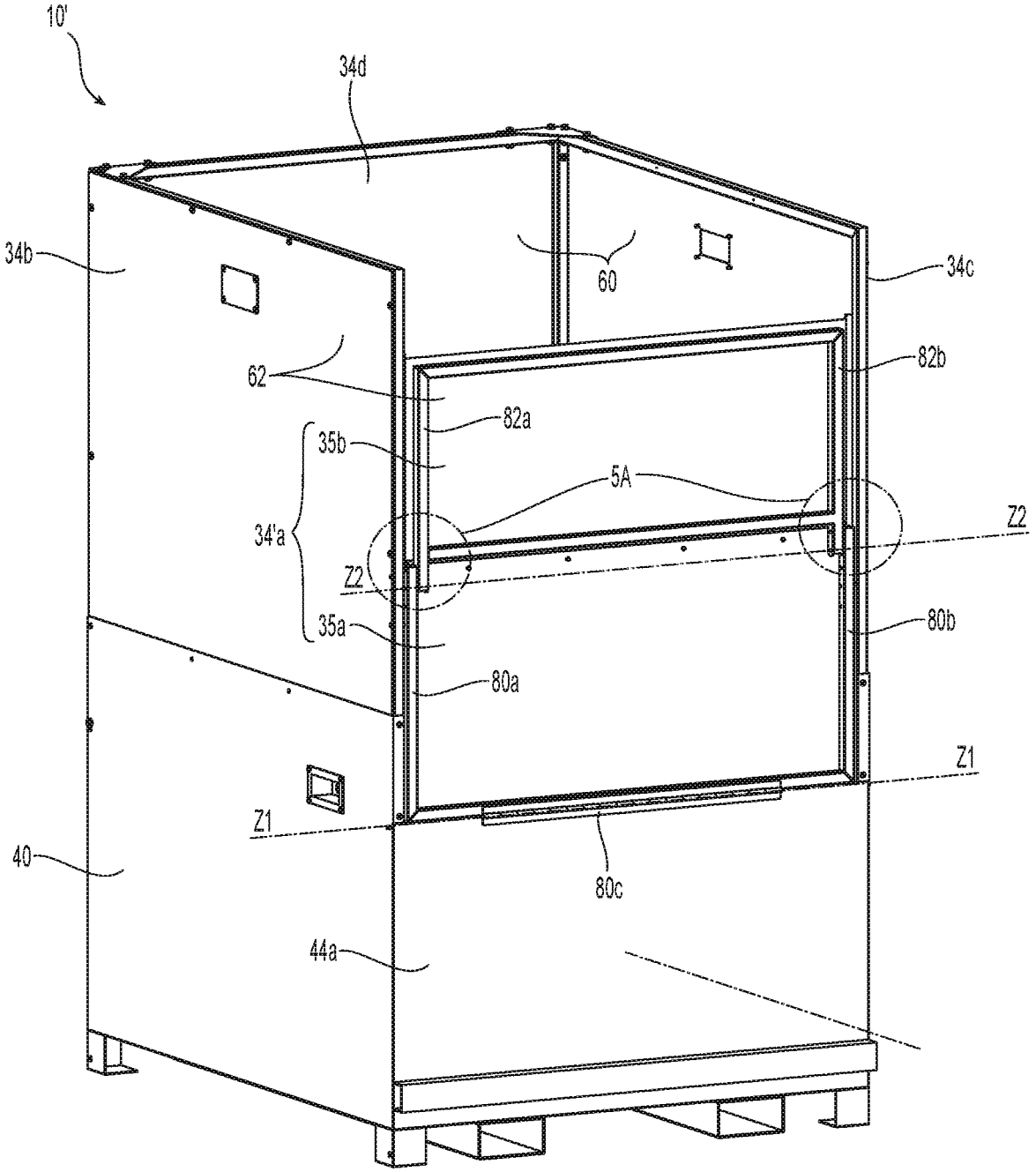
FIG. 5 is a perspective view of another preferred embodiment of a fire protection containment unit for an intermediate bulk container in a fully contained configuration.
Figure 5A:
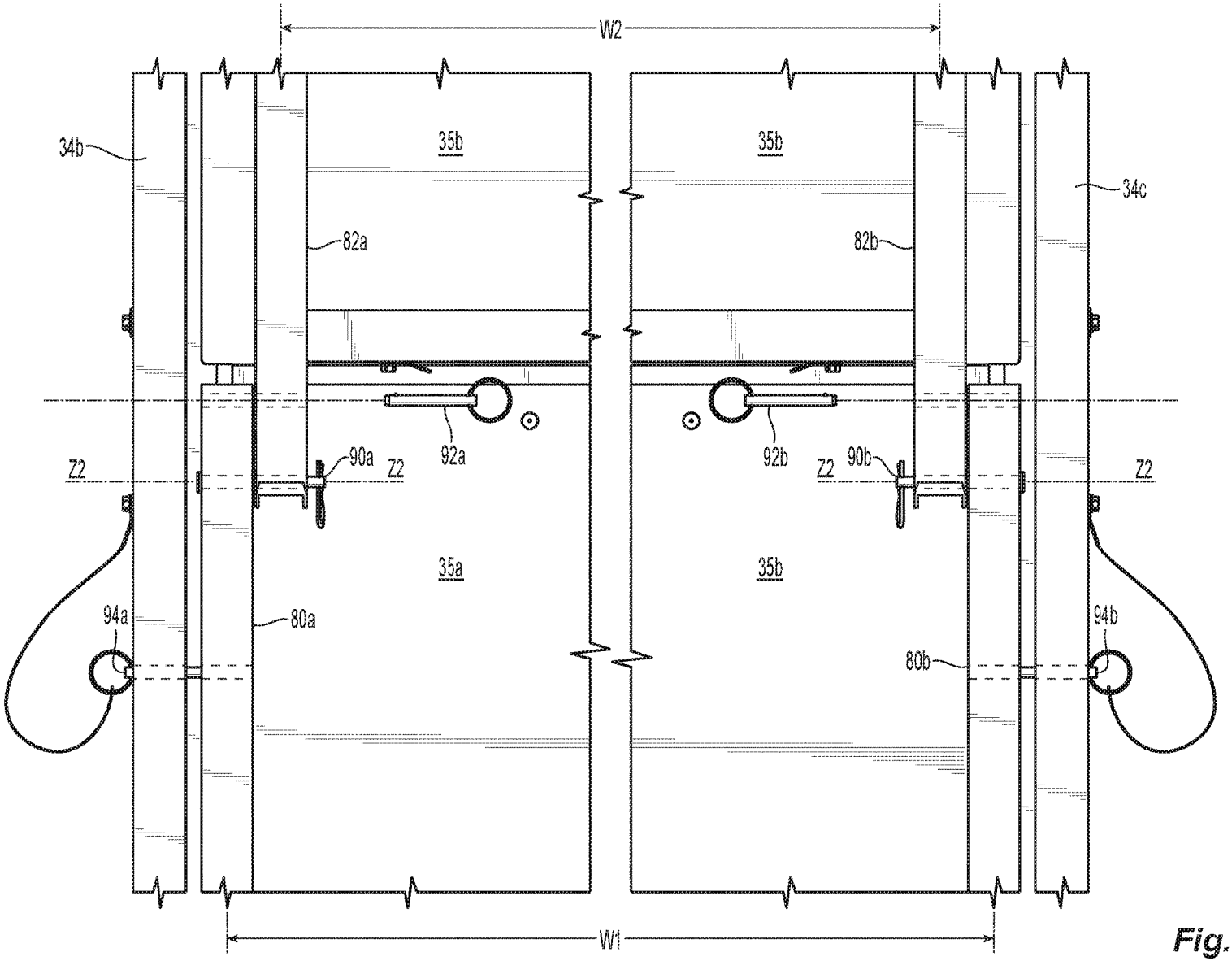
FIG. 5A is an elevation detailed view of the containment unit of FIG. 5.
Figure 5B:
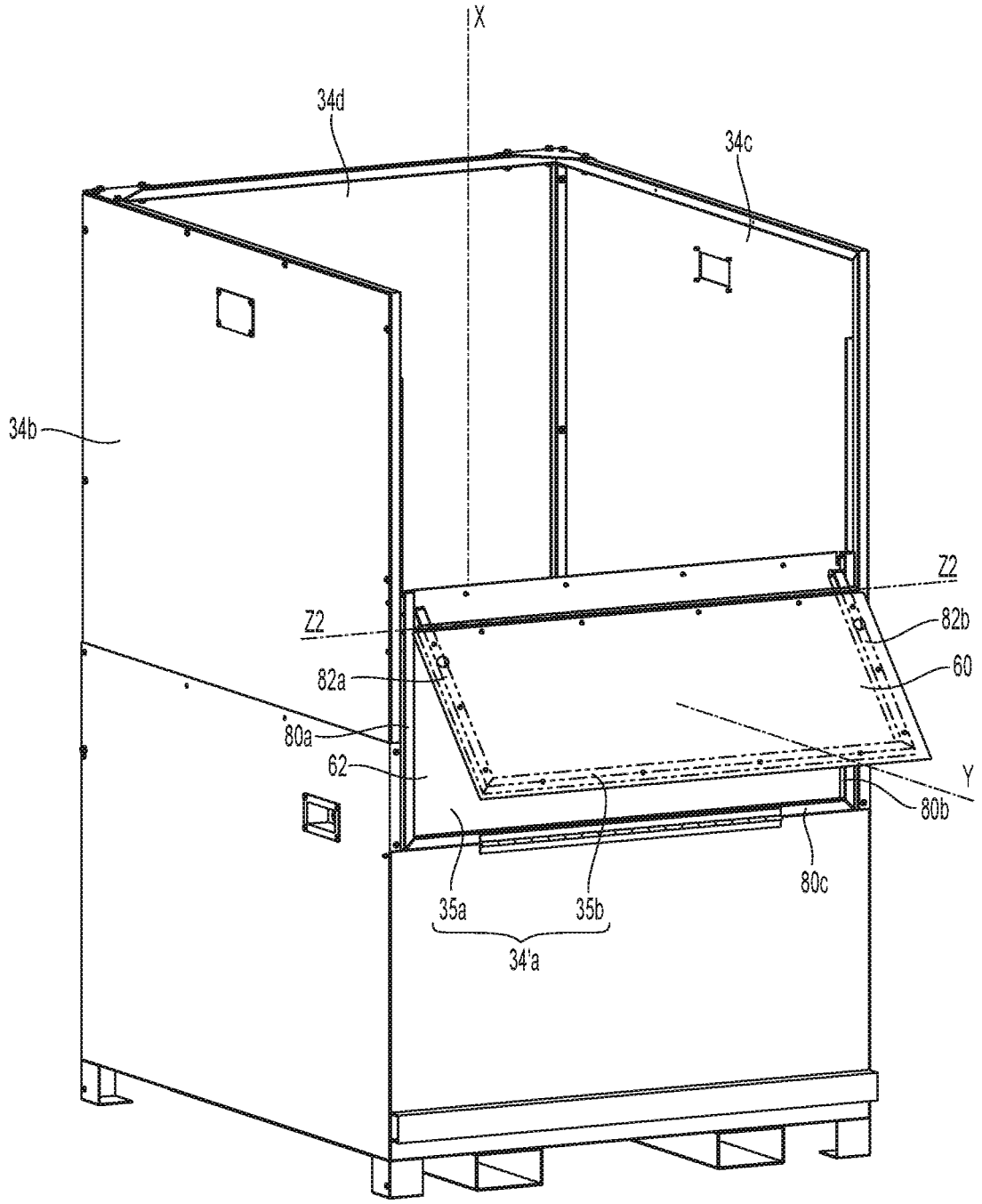
FIG. 5B is a perspective view of the fire protection containment unit of FIG. 5 in a partially open configuration.

Shown in FIGS. 5 and 5A-5B, are views of a preferred alternate embodiment of the containment unit 10'. Components common with the previously described containment unit are described using common reference numbers. Moreover, it should be understood that any feature of any described embodiment of containment unit can be incorporated into another embodiment of containment unit or combined with other containment unit features to provide for other alternate embodiments of the containment unit. Like the previously described embodiment, the fully assembled containment unit 10' includes a basin portion 40 and a containment portion 30 axially atop the basin portion 40. Each of the base portion 40 and the containment portion 30 includes a preferred arrangement of containment walls 34, 44. The containment walls provide for a preferred splash guard and/or door that includes multiple panels, each in a horizontal hinged relationship to permit the guard or door to define various preferred configurations of the containment unit including as completely open, partially open or fully contained configuration to load, inspect and/or use the containment unit with an appropriate IBC 20. Moreover, the preferred multiple hinges of the preferred door allow the panels of the door to be nested with one another to provide a compact assembly for ease of handling and operation.

In the preferred containment unit 10' of FIG. 5, a base of the basing portion 40 is preferably disposed perpendicular to the central axis X-X of the containment unit 10'. The basin portion 40 includes a first plurality containment walls 44 disposed about the base 42 to define a fluid tight chamber of the basin portion 40. Preferably, four planar containment walls 44 are disposed about the perimeter of the base 42 to surround the central axis X-X and form the fluid tight preferably rectangular prismatic chamber of the basin portion 40. In preferred embodiments of the unit 10', the base 42 is preferably inclined forward at an angle, as previously described, to provide a preferred pooling region. Accordingly, the containment unit 10' can include a support portion 50 with legs 52, 54 to provide for the preferred incline.

The containment portion 30 includes a second plurality of containment walls 34 that surround the central axis X-X for the protection of the IBC 20. The second plurality of containment walls 34 preferably includes at least three adjacent walls, and more preferably four adjacent walls 34, axially atop the basin portion 40 with one or more of the walls defining a preferred door 34' a of the containment portion of the unit 10'. The door 34' a is preferably a multi-panel door and more preferably a two-door or two-paneled door that preferably includes a first door panel 35*a* and a second door panel 35*b*. The first door panel 35*a* is preferably in a first horizontal hinged relationship with the basin portion 40 such that the first door panel 35*a* pivots about a first axis Z1-Z1 that is parallel to the ground. The second door panel 35*b* is preferably in a second horizontal hinged relationship with the first panel 35*a* to pivot about a second axis Z2-Z2 parallel to the ground. The pivoted relationships of the door panels define preferred configurations of the containment unit 10.

Shown in FIG. 5, the containment unit 10' is shown in the fully contained configuration with each of the first door panel 35*a* and the second door panel 35*a* are pivoted to their respective closed positions. More specifically, in the preferred fully contained configuration, the preferred first horizontal hinged relationship locates the first door panel 35*a* axially atop the basin portion 40 preferably atop the wall 44*a*. The second horizontal hinged relationship locates the second door panel 35*b* axially in line with and atop the first door panel 35*a*. In the fully contained configuration, each of the upright first door panel 35*a* and the upright second door panel 35*b* define a preferred splash guard at its maximum height. Preferably, when the door 34' a is axially aligned with and atop the front wall 44*a* of the basin portion 40, the upper edge of the door 34' a is preferably located at 80-95% and more preferably 85-90% of the overall height of the containment unit.

In the fully contained configuration of the unit 10', each of the containment walls 34, 44 define an inner surface 60 of the containment unit 10' and an external surface 62 of the containment unit 10'. In the preferred embodiment of the door 34' a, the inner and outer surfaces 60, 62 of the door 34' a confront other surfaces of the unit 10 to define other preferred configurations of the unit. The first and second panels 35*a*, 35*b* are preferably capable of pivoting independently from one another, and shown in FIG. 5B, is the containment unit 10' in a partially open configuration in which the second panel 35*b* is pivoted to an open position and the first door panel 35*a* remains in the closed contained configuration. As illustrated, the second panel 35*b* pivots so that its external surface 62 of the second panel 35*b* confronts the external surface 62 of the first panel 35*a*. In the partially open configuration, the upright first door panel 35*a* can serve as a splash guard with the second door panel 35*b* in a folded open position providing limited access into the unit 10'.

In the preferred partially open configuration, the panels 35*a*, 35*b* define a preferred nested relationship in which the panels are stacked or adjacent to one another along the axis Y-Y that extends radially with respect to the central axis X-X. Moreover, the second panel 35*b* is sized so that the peripheral edges of the second panel 35*b* do not extend beyond the peripheral edges of the first panel 35*a* in the preferred nested relationship. Preferably, the second panel 35*b* and first panel 35*a* define a common width. To facilitate the nested relationship between the panels 35*a*, 35*b*, the door 34'*a* includes a preferred frame that provides for the preferred hinged relationship between the first and second panels 35*a*, 35*b*. With reference to FIG. 5, mounted to the first panel 35*a* are a first pair of parallel preferably elongate members 80*a*, 80*b* spaced apart along the second pivot axis Z2-Z2. Mounted to the second panel 35*b* are a second pair of parallel preferably elongate members 82*a*, 82*b* spaced apart along the second pivot axis. Each member in the second pair of members 82*a*, 82*b* are respectively pinned to an adjacent member of the first pair of members 80*a*, 80*b* by a pair of preferably locked pin members 90*a*, 90*b*, as seen in FIG. 5A, to define the preferred hinge relationship between the panels 35*a*, 35*b* along the second axis Z2-Z2. The elongate members 80*a*, 80*b* and 82*a*, 82*b* are preferably formed from steel tubing with appropriate through bores formed therein for making the pin connections. To secure the second panel 35*b* in either the full containment configuration as seen in FIG. 5 or the partially open configuration in FIG.

5B, the frame includes a pair of removable pins 92*a*, 92*b* that are respectively selectively insertable between the joined members 80*a*, 82*a* and 80*b*, 82*b* to place the panels in the desired configuration. More preferably, the removable pins 92*a*, 92*b* are located in one of two through holes in the members 80*a*, 82*a* and 80*b*, 82*b* to either side of the locked pin members 90*a*, 90*b*. Accordingly, the removable pins form pin connections that operate parallel to the pivot axis Z2-Z2, thereby locking the panel in the selected open or contained configuration. Moreover, a second set of removable pins 94*a*, 94*b* preferably form a pin connection between the lateral walls 34*b*, 34*c* and the first parallel members 80*a*, 80*b* to secure the first panel 35*a* in its containment configuration. Preferably, in the containment configuration, the second set of removable pins 94*a*, 94*b* act parallel to the second pivot axis Z2-Z2 and are located closer to the second pivot axis than to the first pivot axis Z1-Z1. By locating the various pin connections proximate one another, handling, operation and configuring of the door 34'*a* becomes easier.

To form the preferred nested relationship between the panels, the second pair of elongated members 82*a*, 82*b* are preferably spaced apart from one another at a smaller distance than the distance between the first pair of members 80*a*, 80*b*. Preferably, the second pair of members 82*a*, 82*b* are located between and more preferably respectively just inside the first pair of members 80*a*, 80*b*. Accordingly, when the external surface 62 of the second panel 35*b* confronts the external surface 62*b* of the first panel in the preferred partially open configuration, the joined members 80*a*, 82*a* and 80*b*, 82*b* are aligned with one another between the first and second panels 35*a*, 35*b*.

Figure 5C:
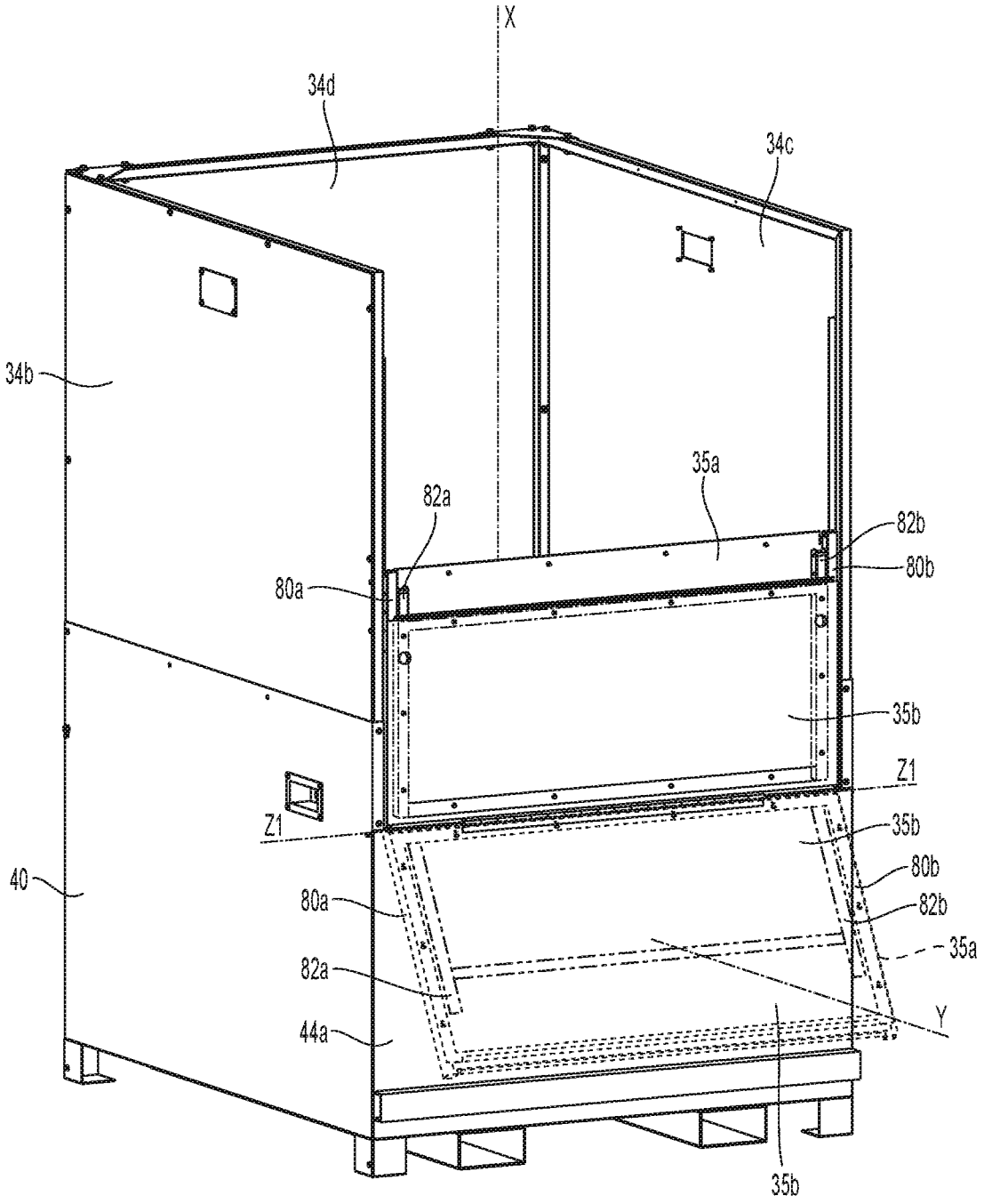
FIG. 5C is a perspective view illustrating a change in the fire protection unit from the partially open configuration of FIG. 5B to a fully open configuration.
Figure 5D:
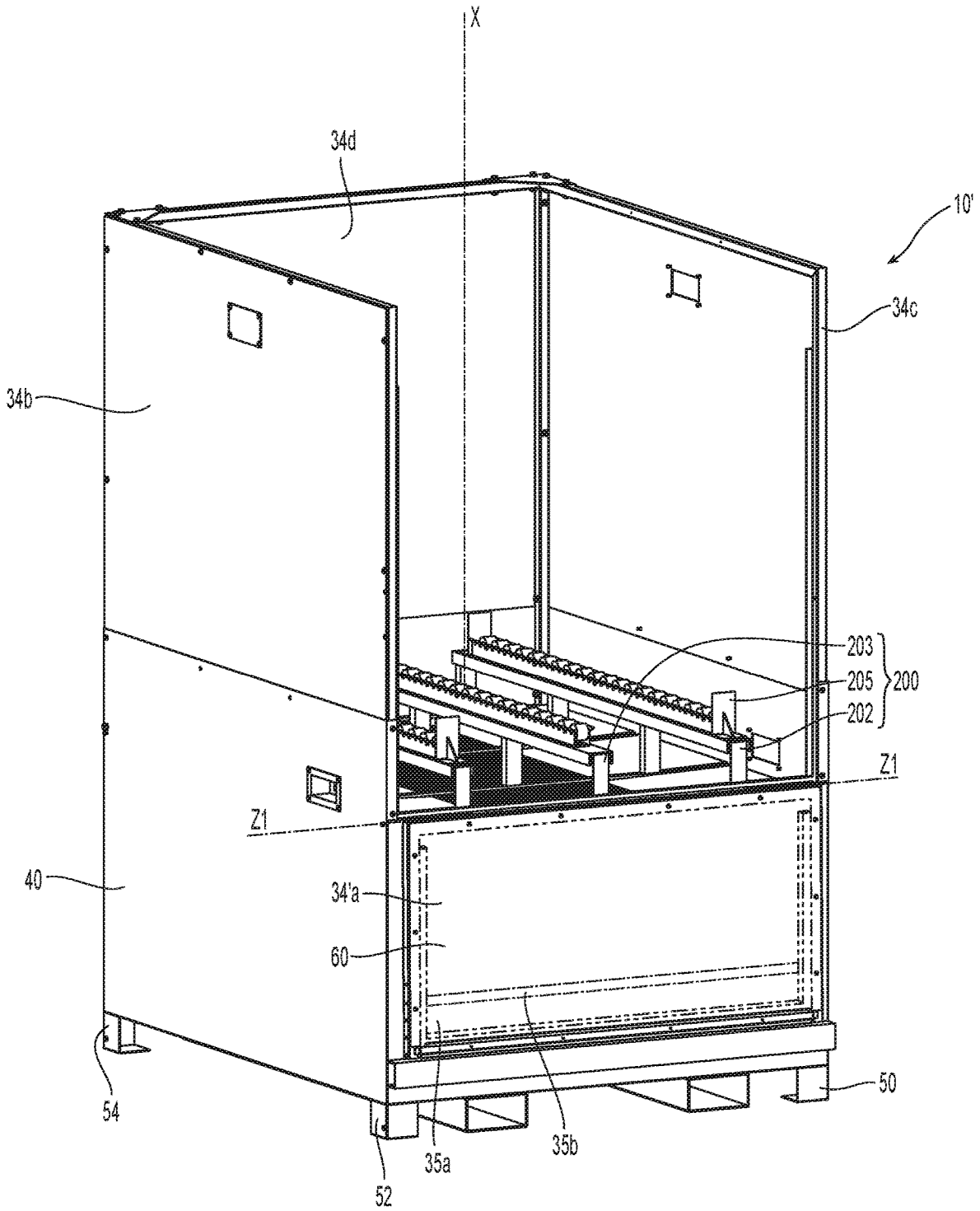
FIG. 5D is a perspective view of the fire protection containment unit of FIG. 5 in the fully open configuration.

In FIGS. 5C and 5D, the containment unit 10 is shown in a fully open configuration of the door 34*a*, the containment portion 30 is fully exposed for loading an IBC 20 into the unit 10 or removing an IBC 20 therefrom. In the preferred fully open configuration of the door 34'*a*, the first horizontal hinged relationship pivots the nested first door panel 35*a* and second panel 35*b* together about the first pivot axis Z1-Z1 so that the door 34'*a* is located adjacent the basin portion 40 and preferably adjacent the front wall 44*a*. The frame of the door 34'*a* preferably includes a third elongate member preferably mounted to the first door panel 35*a* and configured as a cross-member 80*c* between the first pair of parallel elongate members 80*a*, 80*b*, as seen in FIG. 5. The cross-member 80*c* is preferably hinged with the front panel 44*a* of the basin portion to define the preferred first hinged relationship about the first pivot axis Z1-Z1. In the preferred nested arrangement of the door 34' a in the fully open configuration, the inner surface 60 of the second panel 35*b* confronts the front wall 44*a* and the inner surface 62 of the first door panel 35*a* is exposed at the periphery of the containment unit 10. In another preferred aspect of nested door 34'*a* assembly, the preferred first and second panels 35*a*, 35*b* are sized and geometrically configured so as to fit within the periphery of the walls 44, and in particular the preferred front panel 44*a*, of the basin portion 40 and the geometric borders of the prismatic containment unit 10' in the fully open configuration.

The nested first and second door panels 35*a*, 35*b* of the door 34'*a* are preferably located below the preferred rack arrangement 200 and internal flame and drain barrier 100 that is supported between the containment portion 30 and the basin portion 40. With the door 34'*a* folded out of the way in the fully open configuration, the space within the containment portion 30 in which to load or remove an IBC 20 is maximized. Moreover, the preferred nested arrangement of the multi-panel door 34' a provides for easy opening in the open configurations of the containment unit 10' and closing in the fully contained configuration of the unit. Additionally, the preferred nested arrangement is believed to minimize any changes in the center of gravity of the containment unit 10', whether loaded or not, by operation of the door 34'*a*, which can minimize or eliminate instability in the unit 10' and thereby avoid tilting or tipping over the containment unit 10'.

Figure 6:
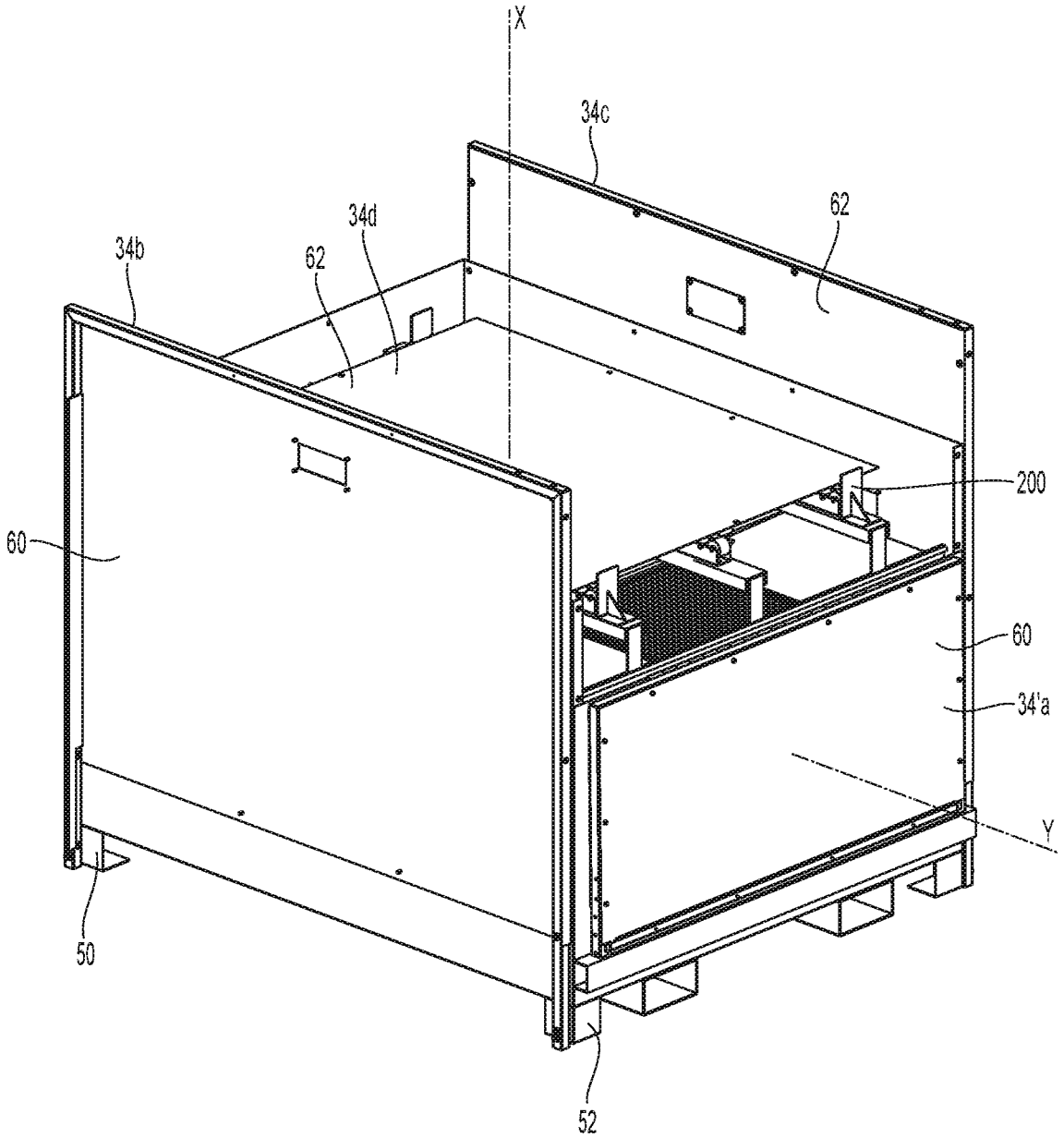
FIG. 6 is another perspective view of the fire protection containment unit of FIG. 5.
Figure 6A:
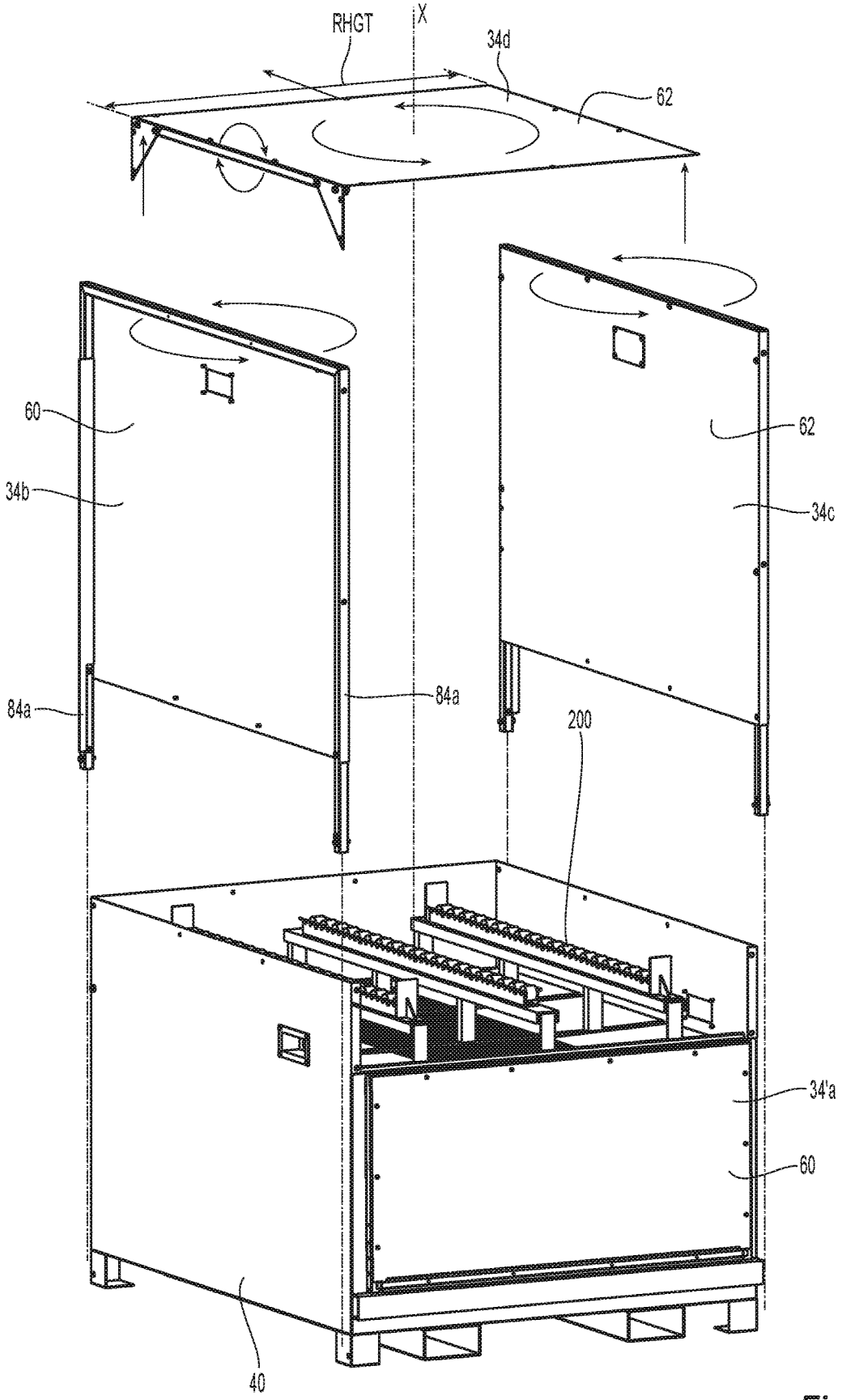
FIG. 6A is an exploded perspective views of the fire protection containment unit of FIG. 6.

Shown in FIGS. 6 and 6A, is another preferred configuration of the containment unit 10' for storage, transport or delivery in which the upper containment walls 34 of the containment portion 30 are disposed about and adjacent the basin portion 40. The preferred packaged configuration provides for a compact assembly with a reduced overall height. The two lateral containment walls 34*b*, 34*c* are removed from atop the basin portion 40 and disposed laterally about the basin portion 40 with the back panel 34*d* also removed from its position atop the basin portion 40 and relocated atop the rack arrangement 200 and disposed perpendicular to the central axis X-X as shown. The preferred door 34' a is in its nested fully open configuration position. With reference to FIG. 6A, in order to locate the rear containment wall 34*d* atop the rack arrangement 200, the rear wall 34*d* is turned perpendicular to the central axis X-X and rotated ninety degrees (90°) about the central axis X-X. The height of the rear wall 34'*d* RHGT is preferably less than the spacing between the two lateral walls 34*b*, 34*c* in order to fit the rear wall 34*d* within the space atop the rack arrangement 200.

As seen in FIG. 6A, each of the lateral walls 34*b*, 34*c* preferably includes a steel panel mounted to a frame that includes elongate parallel side members that extend below the steel panel to define parallel leg members 84*a*, 84*b*. In the operational configurations of the unit, the leg members 84*a*, 84*b* engage the basin portion 40 to locate and secure the lateral walls 34*b*, 34*c* atop the containment walls 44 of the basin portion 40 in the unit 10'. In the preferred packaged configuration, each of the lateral walls 34*b*, 34*c* are separated from the basin portion 40 and rotated about its vertical bisecting access and located so that the external surface 62 of each lateral wall 34*b*, 34*c* confronts respective lateral walls of the basin portion 40. Accordingly, the inner surfaces 60 of each lateral wall 34*b*, 34*c* defines a peripheral surface of the containment unit 10' in the preferred delivery configuration. To secure the lateral walls 34*b*, 34*c* about the basin portion 40, the legs 84*a*, 84*b* are preferably fastened to the support portion 50 of the containment unit 10'.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fire protection containment unit for an intermediate bulk container (IBC), the storage container being configured for location on a ground plane, the containment unit comprising:

a basin portion having a planar base perpendicular to a central axis, the planar base having a rectangular perimeter, and a plurality of containment walls secured to the planar base surface to surround the central axis and define a fluid-tight rectangular prism chamber; a pair of front legs, each of the pair of front legs having a top surface secured to the planar base surface of the basin and a bottom surface that contacts the ground plane;

a pair of rear legs secured to the planar base of the basin, each of the pair of rear legs having a top surface secured to the planar base surface of the basin and a bottom surface that contacts the ground plane;

a flame and drain barrier supported over the planar base, the flame and drain barrier including a plurality of strut members extending between two of the containment walls, at least one pair of lateral pans and a central grid supported on the plurality of struts and suspended over the fluid-tight rectangular prism chamber, each of the pair of lateral pans has a rectangular drainage surface disposed with respect to the ground plane, each drainage surface having four corners with each corner of the rectangular surface defining a distance from the ground plane, the distances being different from one another, each containment wall in the plurality of containment walls forming a splash guard spaced about the central axis, at least one splash guard defining a door having a first door panel in a first horizontal hinged relationship with a wall in the plurality of containment walls and a second door panel in a second horizontal hinged relationship with the first panel.

2. The containment unit of claim 1, wherein each of the front legs define a first height and each of the rear legs define a second height, the second height being greater the first height.

3. The containment unit of claim 2, wherein the first height and the second height define a height differential ranging from 5/32 to 3/32 inches.

4. The containment unit of claim 3, wherein the containment unit is at least two meters (6½ ft.) high, about 1.5 meters wide (5 ft.) and about two meters (6 ft.) deep.

5. The containment unit of claim 1, wherein the at least one pair of lateral pans and the central grid include a plurality of pairs of lateral pans and a plurality of central grids, each pair of lateral pans having one of the central grids therebetween.

6. The containment unit of claim 5, wherein for each pair of lateral pans, the drainage surface is angled toward the central grid therebetween with the central grid being disposed below the drainage surfaces.

7. The containment unit of claim 5, wherein each of the plurality of strut members include a shelf that supports the plurality of pairs of lateral pans.

8. The containment unit of claim 7, wherein the strut members are spaced apart from one another to space the shelves apart to support one pair of lateral pans and one central grid between spaced apart strut member.

9. The containment unit of claim 1, wherein the base defines an angle of incline with respect to a plane parallel to the ground plane, the angle of incline being greater than zero and less than forty degrees.

10. The containment unit of claim 9, wherein the angle of incline is less than ten degrees.

11. The containment unit of claim 10, wherein the angle of incline is less than one degree.

12. The containment unit of claim 9, further including a rack arrangement supported on the flame and drain barrier, the rack arrangement being on the angle of incline.

13. The containment unit of claim 1, wherein the at least one splash guard includes a front splash guard, a rear splash guard, and a pair of lateral splash guards.

14. The containment unit of claim 1, wherein the containment unit is configured to house an IBC containing at least 1000 liters (265 gal.) and the basin portion has a holding capacity of at least 1,105 liters (292 gal.).

15. A fire protection containment unit for an intermediate bulk container (IBC), the storage container being configured for location on a ground plane, the containment unit comprising:

a basin portion having a planar base perpendicular to a central axis, the planar base having a rectangular perimeter, and a plurality of containment walls secured to the planar base surface to surround the central axis and define a fluid-tight rectangular prism chamber; a pair of front legs, each of the pair of front legs having a top surface secured to the planar base surface of the basin and a bottom surface that contacts the ground plane;

a pair of rear legs secured to the planar base of the basin, each of the pair of rear legs having a top surface secured to the planar base surface of the basin and a bottom surface that contacts the ground plane; and a flame and drain barrier supported proximate an upper boundary of each of the containment walls, the flame and drain barrier including a plurality of strut members extending between two of the containment walls, at least one pair of lateral pans and a central grid supported on the plurality of struts and suspended over the fluid-tight rectangular prism chamber, wherein each of the pair of lateral pans has a rectangular drainage surface disposed with respect to the ground plane, each drainage surface having four corners with each corner of the rectangular surface defining a distance from the ground plane, the distances being different from one another.

16. A fire protection containment unit for an intermediate bulk container (IBC) comprising:

a containment portion for housing the IBC;

a basin portion having a base at an angle of incline to define a pooling region;

an internal flame and drain barrier supported between the containment portion and the basin portion to catch escaped liquid from the IBC and direct the escaped liquid into the basin portion, the barrier including a plurality of lateral pans with a central grid member in between; and a plurality of splash guards spaced about the containment and the basin portions, at least one splash guard defining a door including a first door panel in a first horizontal hinged relationship with the basin portion and a second door panel in a second horizontal hinged relationship with the first panel.

17. A fire protection containment unit for an intermediate bulk container (IBC) comprising:

a containment portion for housing the IBC;

a basin portion having a base at an angle of incline to define a pooling region; and an internal flame and drain barrier supported between the containment portion and the basin portion to catch escaped liquid from the IBC and direct the escaped liquid into the basin portion, the barrier including a plurality of lateral pans with a central grid member in between;

wherein each pan includes a plurality of sidewalls surrounding an impact surface, each of the sidewalls having a length and a height, at least two of the sidewalls having the height varying over the length of the sidewall.

* * * * *